United States Patent [19]

Emert et al.

[11] Patent Number: 5,030,369

[45] Date of Patent: Jul. 9, 1991

[54] OIL SOLUBLE DISPERSANT ADDITIVES USEFUL IN OLEAGINOUS COMPOSITIONS

[75] Inventors: Jacob Emert, Brooklyn, N.Y.; Robert D. Lundberg, Bridgewater; Antonio Gutierrez, Mercerville, both of N.J.

[73] Assignee: Exxon Chemical Patents Inc., Linden, N.J.

[21] Appl. No.: 291,754

[22] Filed: Dec. 29, 1988

Related U.S. Application Data

[63] Continuation-in-part of Ser. No. 161,904, Feb. 29, 1988, Pat. No. 4,957,645.

[51] Int. Cl.[5] ..... C10M 135/32

[52] U.S. Cl. ..... 252/47.5; 252/51.5 A; 252/51.5 R; 548/546; 564/154

[58] Field of Search ..... 252/47.5; 548/564; 564/154

[56] References Cited

U.S. PATENT DOCUMENTS

| | | | |
|---|---|---|---|
| 3,078,271 | 2/1963 | De Groote et al. | 260/247.5 |
| 3,272,746 | 9/1966 | Le Suer et al. | 252/47.5 |
| 3,367,943 | 2/1968 | Miller et al. | 260/326.3 |
| 3,373,111 | 3/1968 | LeSuer et al. | 252/51.5 |
| 3,381,022 | 4/1968 | LeSuer et al. | 260/404.8 |
| 3,442,808 | 6/1969 | Traise et al. | 252/49.6 |
| 3,458,530 | 7/1969 | Siegel et al. | 260/326.5 |
| 3,539,633 | 11/1970 | Plasek et al. | 260/570.5 |
| 3,579,450 | 5/1971 | Le Suer et al. | 252/56 |
| 3,591,598 | 7/1971 | Traise et al. | 260/296 |
| 3,630,904 | 12/1971 | Musser et al. | 252/51.5 |
| 3,692,182 | 6/1972 | Steele et al. | 260/47 |
| 3,705,109 | 12/1972 | Hausler et al. | 252/392 |
| 3,836,470 | 9/1974 | Miller | 252/51.5 |
| 3,836,471 | 9/1974 | Miller | 252/51.5 |
| 3,842,010 | 10/1974 | Pappas et al. | 252/51.5 |
| 3,850,826 | 11/1974 | de Vries | 252/51.5 |
| 3,859,318 | 1/1975 | Le Suer | 260/410.6 |
| 3,879,308 | 4/1975 | Miller | 252/56 |
| 3,957,854 | 5/1976 | Miller | 260/482 |
| 3,957,855 | 5/1976 | Miller | 260/482 |
| 4,097,389 | 6/1978 | Andress, Jr. | 252/51.5 |
| 4,129,508 | 12/1978 | Friihauf | 252/33 |
| 4,234,435 | 11/1980 | Meinhardt et al. | 252/51.5 |
| 4,428,849 | 12/1984 | Wisotsky | 252/33.4 |
| 4,455,243 | 6/1984 | Liston | 252/51.5 |
| 4,482,464 | 11/1984 | Karol et al. | 252/51.5 |
| 4,492,642 | 12/1985 | Horodysky | 252/49 |
| 4,517,104 | 6/1985 | Bloch et al. | 252/51.5 |
| 4,548,724 | 10/1985 | Karol et al. | 252/51.5 |
| 4,579,674 | 4/1986 | Schlicht | 252/51.5 |
| 4,617,137 | 10/1986 | Plavac | 252/49 |
| 4,663,064 | 5/1987 | Nalesnik et al. | 252/51.5 |
| 4,780,230 | 10/1988 | Liu et al. | 252/51.5 R |

*Primary Examiner*—Jacqueline V. Howard
*Assistant Examiner*—Maria Nuzzolillo
*Attorney, Agent, or Firm*—M. B. Kapustij; E. R. Skula

[57] ABSTRACT

An oil soluble dispersant comprising the reaction products of:

(1)(i) oil soluble salts, amides, imides, oxazolines, esters, or mixtures thereof of long chain hydrocarbyl substituted mono- and dicarboxylic acids or their anhydrides; (ii) long chain hydrocarbon having a polyamine attached directly thereto; (iii) Mannich condensation product formed by condensing a long chain hydrocarbyl substituted hydroxy aromatic compound with an aldehyde and a polyamine; and (iv) Mannich condensation product formed by reacting long chain hydrocarbyl substituted mono or dicarboxylic acids or their anhydrides with an aminophenol, which may be optionally hydrocarbyl substituted, to form a long chain hydrocarbyl substituted amide or imide-containing phenol intermediate adduct, and condensing said long chain hydrocarbyl substituted amide or imide-containing phenol adduct with aldehyde and polyamine; said adduct containing at least one reactive group selected from reactive amino groups and reactive hydroxyl groups; and (2) at least one polythioepoxide. Also disclosed are oleaginous compositions, particularly lubricating oil compositions, containing said dispersant.

24 Claims, No Drawings

OIL SOLUBLE DISPERSANT ADDITIVES USEFUL IN OLEAGINOUS COMPOSITIONS

RELATED APPLICATIONS

This application is a continuation-in-part application of copending U.S. application Ser. No. 161,904, filed Feb. 29, 1988, now U.S. Pat. No. 4,957,645.

FIELD OF THE INVENTION

This invention relates to oil soluble compositions useful in dispersant additives for oleaginous compositions, particularly lubricating oil compositions, including concentrates containing said additives, and methods for their manufacture and use. The dispersant additives of the instant invention are comprised of the reaction products of (1) nitrogen or ester containing adduct and (2) polythioepoxide.

BACKGROUND OF THE INVENTION

Multigrade lubricating oils typically are identified by two numbers such as 10W30, 5W30 etc. The first number in the multigrade designation is associated with a maximum low temperature (e.g. −20° C.) viscosity requirement for that multigrade oil as measured typically by a cold cranking simulator (CCS) under high shear, while the second number in the multigrade designation is associated with a minimum high temperature (e.g. 100° C.) viscosity requirement. Thus, each particular multigrade oil must simultaneously meet both strict low and high temperature viscosity requirements in order to qualify for a given multigrade oil designation. Such requirements are set e.g., by ASTM specifications. By "low temperature" as used herein is meant temperatures of typically from about −30° to about −5° C. By "high temperature" as used herein is meant temperatures of typically at least about 100° C.

The minimum high temperature viscosity requirement, e.g. at 100° C., is intended to prevent the oil from thinning out too much during engine operation which can lead to excessive wear and increased oil consumption. The maximum low temperature viscosity requirement is intended to facilitate engine starting in cold weather and to ensure pumpability, i.e., the cold oil should readily flow or slump into the well for the oil pump, otherwise the engine can be damaged due to insufficient lubrication.

In formulating an oil which efficiently meets both low and high temperature viscosity requirements, the formulator may use a single oil of desired viscosity or a blend of two lubricating oils of different viscosities, in conjunction with manipulating the identity and amount of additives that must be present to achieve the overall target properties of a particular multigrade oil including its viscosity requirements.

The natural viscosity characteristic of a lubricating oil is typically expressed by the neutral number of the oil (e.g. S150N) with a higher neutral number being associated with a higher natural viscosity at a given temperature. In some instances the formulator will find it desirable to blend oils of two different neutral numbers, and hence viscosities, to achieve an oil having a viscosity intermediate between the viscosity of the components of the oil blend. Thus, the neutral number designation provides the formulator with a simple way to achieve a desired base oil of predictable viscosity. Unfortunately, merely blending oils of different viscosity characteristics does not enable the formulator to meet the low and high temperature viscosity requirements of multigrade oils. The formulator's primary tool for achieving this goal is an additive conventionally referred to as a viscosity index improver (i.e., V.I. improver).

The V.I. improver is conventionally an oil-soluble long chain polymer. The large size of these polymers enables them to significantly increase kinematic viscosities of base oils even at low concentrations. However, because solutions of high polymers are non-Newtonian they tend to give lower viscosities than expected in a high shear environment due to the alignment of the polymer. Consequently, V.I. improvers impact (i.e., increase) the low temperature (high shear) viscosities (i.e. CCS viscosity) of the base oil to a lesser extent than they do the high temperature (low shear) viscosities.

The aforesaid viscosity requirements for a multigrade oil can therefore be viewed as being increasingly antagonistic at increasingly higher levels of V.I. improver. For example, if a large quantity of V.I. improver is used in order to obtain high viscosity at high temperatures, the oil may now exceed the low temperature requirement. In another example, the formulator may be able to readily meet the requirement for a 10W30 oil but not a 5W30 oil, with a particular ad-pack (additive package) and base oil. Under these circumstances the formulator may attempt to lower the viscosity of the base oil, such as by increasing the proportion of low viscosity oil in a blend, to compensate for the low temperature viscosity increase induced by the V.I. improver, in order to meet the desired low and high temperature viscosity requirements. However, increasing the proportion of low viscosity oils in a blend can in turn lead to a new set of limitations on the formulator, as lower viscosity base oils are considerably less desirable in diesel engine use than the heavier, more viscous oils.

Further complicating the formulator's task is the effect that dispersant additives can have on the viscosity characteristics of multigrade oils. Dispersants are frequently present in quality oils such as multigrade oils, together with the V.I. improver. The primary function of a dispersant is to maintain oil insolubles, resulting from oxidation during use, in suspension in the oil thus preventing sludge flocculation and precipitation. Consequently, the amount of dispersant employed is dictated and controlled by the effectiveness of the material for achieving its dispersant function. A high quality 10W30 commercial oil might contain from two to four times as much dispersant as V.I. improver (as measured by the respective dispersant and V.I. improver active ingredients). In addition to dispersancy, conventional dispersants can also increase the low and high temperature viscosity characteristics of a base oil simply by virtue of their polymeric nature. In contrast to the V.I. improver, the dispersant molecule is much smaller. Consequently, the dispersant is much less shear sensitive, thereby contributing more to the low temperature CCS viscosity (relative to its contribution to the high temperature viscosity of the base oil) than a V.I. improver. Moreover, the smaller dispersant molecule contributes much less to the high temperature viscosity of the base oil than the V.I. improver. Thus, the magnitude of the low temperature viscosity increase induced by the dispersant can exceed the low temperature viscosity increase induced by the V.I. improver without the benefit of a proportionately greater increase in high temperature viscosity as obtained from a V.I. improver.

Consequently, as the dispersant induced low temperature viscosity increase causes the low temperature viscosity of the oil to approach the maximum low temperature viscosity limit, the more difficult it is to introduce a sufficient amount of V.I. improver effective to meet the high temperature viscosity requirement and still meet the low temperature viscosity requirement. The formulator is thereby once again forced to shift to the undesirable expedient of using higher proportions of low viscosity oil to permit addition of the requisite amount of V.I. improver without exceeding the low temperature viscosity limit.

In accordance with the present invention, dispersants are provided which have inherent characteristics such that they contribute considerably less to low temperature viscosity increases than dispersants of the prior art while achieving similar high temperature viscosity increases. Moreover, as the concentration of dispersant in the base oil is increased, this beneficial low temperature viscosity effect becomes increasingly more pronounced relative to conventional dispersants. This advantage is especially significant for high quality heavy duty diesel oils which typically require high concentrations of dispersant additive. Furthermore, these improved viscosity properties facilitate the use of V.I. improvers in forming multigrade oils spanning a wider viscosity requirement range, such as 5W30 oils, due to the overall effect of lower viscosity increase at low temperatures while maintaining the desired viscosity at high temperatures as compared to the other dispersants. More significantly, these viscometric properties also permit the use of higher viscosity base stocks with attendant advantages in engine performance. Furthermore, the utilization of the dispersant additives of the instant invention allows a reduction in the amount of V.I. improvers required.

The materials of this invention are thus an improvement over conventional dispersants because of their effectiveness as dispersants coupled with enhanced low temperature viscometric properties. These materials are particularly useful with V.I. improvers in formulating multigrade oils.

SUMMARY OF THE INVENTION

The present invention is directed to improved oil soluble dispersants comprising nitrogen or ester, preferably nitrogen, containing conventional dispersants or adducts which are post-reacted with at least one polythioepoxide. The nitrogen or ester containing adducts or intermediates which are reacted with the polythioepoxide to form the improved dispersants of this invention comprise members selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; (iii) Mannich condensation products formed by condensing long chain hydrocarbon substituted phenol with an aldehyde such as formaldehyde and polyamine; and (iv) Mannich condensation products formed by reacting long chain hydrocarbon substituted mono or dicarboxylic acids or their anhydrides with an amine substituted hydroxy aromatic compound, preferably an aminophenol, which may be optionally hydrocarbyl substituted, to form a long chain hydrocarbon substituted amide or imide-containing hydroxy aromatic intermediate adduct, and condensing the long chain hydrocarbon substituted amide- or imide-containing androxy aromatic intermediate adduct with an aldehyde such as formaldehyde and a polyamine.

DETAILED DESCRIPTION OF THE INVENTION

In accordance with the present invention there are provided oil soluble dispersant compositions. These dispersants exhibit a high temperature to low temperature viscosity balance or ratio which is more favorable than that of conventional dispersant materials. That is to say the instant dispersant materials possess inherent characteristics such that they contribute less to low temperature viscosity increase than dispersants of the prior art while increasing the contribution to the high temperature viscosity increase.

The improved dispersants of the instant invention are comprised of the oil soluble reaction products of:

(I) nitrogen or ester containing adducts selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; (iii) Mannich condensation products formed by condensing a long chain hydrocarbon substituted phenol with an aldehyde and a polyalkylene polyamine; and (iv) Mannich condensation products formed by reacting long chain hydrocarbon substituted mono and dicarboxylic acids or their anhydrides with an amine substituted hydroxy aromatic compound, preferably aminophenol, which may be optionally hydrocarbyl substituted, to form a long chain hydrocarbon substituted amide or imide-containing hydroxy aromatic intermediate adduct, and condensing the long chain hydrocarbon substituted amide- or imide-containing hydroxy aromatic intermediate adduct with aldehyde such as formaldehyde and polyamine; wherein said long chain hydrocarbon group in (i), (ii), (iii) and (iv) is a polymer of a $C_2$ to $C_{18}$, e.g., $C_2$ to $C_5$ monoolefin, said polymer having a number average molecular weight of about 500 to about 6000; and (II) a polythioepoxide.

The molecular weight of the product is increased by the coupling or linking of two or more molecules of the adduct by or through the polythioepoxide moieties.

The long chain hydrocarbyl substituted mono or dicarboxylic acid producing material, e.g., acid, anhydride, or ester containing adducts classified as (i) above includes the reaction product of a long chain hydrocarbon polymer, generally a polyolefin, with a monounsaturated carboxylic reactant comprising at least one member selected from the group consisting of (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated to the carboxyl group, i.e., of the structure $$-C{=}C-\overset{\overset{\displaystyle O}{\|}}{C}-;$$

and (iv) derivatives of (iii) such as $C_1$ to $C_5$ alcohol derived monoesters of (iii). Upon reaction with the polymer, the monounsaturation of the monounsaturated carboxylic reactant becomes saturated. Thus, for example, maleic anhydride becomes a polymer substituted succinic anhydride, and acrylic acid becomes a polymer substituted propionic acid.

Typically, from about 0.7 to about 4.0 (e.g., 0.8 to 2.6), preferably from about 1.0 to about 2.0, and most preferably from about 1.1 to about 1.7 moles of said monounsaturated carboxylic reactant are charged to the reactor per mole of polymer charged.

Normally, not all of the polymer reacts with the monounsaturated carboxylic reactant and the reaction mixture will contain unreacted polymer. The unreacted polymer is typically not removed from the reaction mixture (because such removal is difficult and would be commercially infeasible) and the product mixture, stripped of any monounsaturated carboxylic reactant is employed for further reaction with the amine or alcohol as described hereinafter to make the dispersant.

Characterization of the average number of moles of monounsaturated carboxylic reactant which have reacted per mole of polymer charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged, using techniques well known in the art. Functionality is defined solely with reference to the resulting product mixture. Although the amount of said reacted polymer contained in the resulting product mixture can be subsequently modified, i.e. increased or decreased by techniques known in the art, such modifications do not alter functionality as defined above. The terms "polymer substituted monocarboxylic acid material" and "polymer substituted dicarboxylic acid material" as used herein are intended to refer to the product mixture whether it has undergone such modifications or not.

Accordingly, the functionality of the polymer substituted mono- and dicarboxylic acid material will be typically at least about 0.5, preferably at least about 0.8, and most preferably at least about 0.9 and will vary typically from about 0.5 to about 2.8 (e.g., 0.6 to 2), preferably from about 0.8 to about 1.4, and most preferably from about 0.9 to about 1.3.

Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and the lower alkyl (e.g., $C_1$ to $C_4$ alkyl) acid esters of the foregoing, e.g., methyl maleate, ethyl fumarate, methyl fumarate, etc.

The hydrocarbyl substituted dicarboxylic acid materials, as well as methods for their preparation, are well known in the art and are amply described in the patent literature. They may be obtained, for example, by the Ene reaction between a polyolefin and an alpha-beta unsaturated $C_4$ to $C_{10}$ dicarboxylic acid, anhydride or ester thereof, such as fumaric acid, itaconic acid, maleic acid, maleic anhydride, chloromaleic acid, dimethyl fumarate, etc.

The hydrocarbyl substituted dicarboxylic acid materials function as acylating agents for the adducts such as those comprised of a nitrogen containing moiety, e.g., polyamine, to form the acylated nitrogen derivatives of hydrocarbyl substituted dicarboxylic acids, anhydrides, or esters which are subsequently reacted with the polythioepoxides to form the dispersants of the present invention.

Preferred olefin polymers for reaction with the unsaturated dicarboxylic acid, anhydride, or ester are polymers comprising a major molar amount of $C_2$ to $C_{18}$, e.g. $C_2$ to $C_5$, monoolefin. Such olefins include ethylene, propylene, butylene, isobutylene, pentene, octene-1, styrene, etc. The polymers can be homopolymers such as polyisobutylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases the olefin polymer may be completely saturated, for example an ethylene-propylene copolymer made by a Ziegler-Natta synthesis using hydrogen as a moderator to control molecular weight.

The olefin polymers will usually have number average molecular weights ($\overline{M}_n$) within the range of about 500 and about 6000, e.g. 700 to 3000, preferably between about 800 and about 2500. An especially useful starting material for a highly potent dispersant additive made in accordance with this invention is polyisobutylene.

Processes for reacting the olefin polymer with the $C_4$–$C_{10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Alternatively, the olefin polymer can be first halogenated, for example, chlorinated or brominated to about 1 to 8 wt. %, preferably 3 to 7 wt. % chlorine or bromine, based on the weight of polymer, by passing the chlorine or bromine through the polyolefin at a temperature of 25 to 160° C., e.g., 120° C., for about 0.5 to 10, preferably 1 to 7 hours. The halogenated polymer may then be reacted with sufficient unsaturated acid or anhydride at 100 to 250° C., usually about 180 to 220° C., for about 0.5 to 10 hours, e.g. 3 to 8 hours, so the product obtained will contain an average of about 0.7 to 2.0 moles, preferably 1.0 to 1.3 moles, e.g., 1.2 moles, of the unsaturated acid per mole of the halogenated polymer. Processes of this general type are taught in U.S. Pat. Nos. 3,087,436; 3,172,892; 3,272,746 and others.

Alternatively, the olefin polymer and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g. polyisobutylene, will normally react with the dicarboxylic acid material. Upon carrying out a thermal reaction without the use of halogen or a catalyst, then usually only about 50 to 85 wt. % of the polyisobutylene will react. Chlorination helps increase the reactivity. For convenience, all of the aforesaid functionality ratios of dicarboxylic acid producing units to polyolefin, e.g. 1.0 to 2.0, etc. are based upon the total amount of polyolefin, that is, the total of both the reacted and unreacted polyolefin, present in the resulting product formed in the aforesaid reactions.

Amine compounds useful as reactants with the hydrocarbyl substituted dicarboxylic acid material, i.e., acylating agent, are those containing at least two reactive amino groups, i.e., primary and secondary amino groups. They include polyalkylene polyamines, of about 2 to 60 (e.g., 2 to 30), preferably 2 to 40 (e.g., 3 to 20) total carbon atoms and about 1 to 12 (e.g., 2 to 9), preferably 3 to 12, and most preferably 3 to 9 nitrogen atoms in the molecule. These amines may be hydrocarbyl amines or may be hydrocarbyl amines including other groups, e.g., hydroxy groups, and the like. Hydroxy amines with 1 to 6 hydroxy groups, preferably 1 to 3 hydroxy groups are particularly useful. Such amines should be capable of reacting with the acid or anhydride groups of the hydrocarbyl substituted dicarboxylic acid moiety and with the thioepoxide rings of the polythioepoxide moiety through the amino functionality or a substituent group reactive functionality. Since tertiary amines are generally unreactive with anhydrides and thioepoxide rings, it is desirable to have at least two primary and/or secondary amino groups on the amine. It is preferred that the amine contain at least one primary amino group, for reaction with the acylating agent, and at least one secondary amino group, for reaction with the polythioepoxide. Preferred amines are aliphatic saturated amines, including those of the general formula:

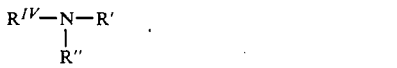

(I)

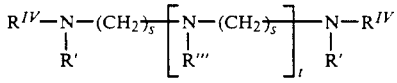

(Ia)

wherein $R^{IV}$, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R'' and R''' can additionally comprise a moiety of the formula

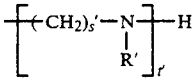

(Ib)

wherein R' is as defined above, and wherein each s and s' can be the same or a different number of from 2 to 6, preferably 2 to 4; and t and t' can be the same or different and are each numbers of typically from 0 to 10, preferably about 2 to 7, most preferably about 3 to 7, with the proviso that t+t' is not greater than 10. To assure a facile reaction it is preferred that $R^{IV}$, R', R'', R''', (s), (s'), (t) and (t') be selected in a manner sufficient to provide the compounds of formula I with typically at least two primary and/or secondary amino groups. This can be achieved by selecting at least one of said $R^{IV}$, R', R'' or R''' groups to be hydrogen or by letting (t) in formula Ia be at least one when R''' is H or when the (Ib) moiety possesses a secondary amino group. The most preferred amines of the above formulas are represented by formula Ia and contain at least two primary amino groups and at least one, and preferably at least three, secondary amino groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene) triamine; N,N'-dimethyl-1,3-diaminopropane; N,N'-di-(2-aminoethyl) ethylene diamine; N,N'-di(2-hydroxyethyl)-1,3-propylene diamine; N-dodecyl-1,3-propane diamine; tris hydroxymethylaminomethane (THAM); diisopropanol amine; diethanol amine; triethanol amine; mono-, di-, and tri-tallow amines; amino morpholines such as N-(3-aminopropyl) morpholine; and mixtures thereof.

Other useful amine compounds include: alicyclic diamines such as 1,4-di(aminoethyl) cyclohexane, and N-aminoalkyl piperazines of the general formula:

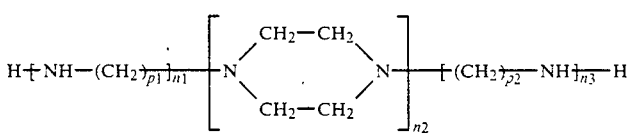

(II)

wherein $p_1$ and $p_2$ are the same or different and are each integers of from 1 to 4, and $n_1$, $n_2$ and $n_3$ are the same or different and are each integers of from 1 to 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2\text{—alkylene—O-alkylene)}_m NH_2 \quad \text{(III)}$$

where m has a value of about 3 to 70 and preferably 10 to 35; and $$R^V\text{—alkylene—O-alkylene)}NJ_2) \quad \text{(IV)}$$

where n has a value of about 1 to 40, with the provision that the sum of all the n's is from about 3 to about 70, and preferably from about 6 to about 35, and $R^V$ is a substituted saturated hydrocarbon radical of up to 10 carbon atoms, wherein the number of substituents on the $R^V$ group is from 3 to 6. The alkylene groups in either formula (III) or (IV) may be straight or branched chains containing about 2 to 7, and preferably about 2 to 4 carbon atoms.

The polyoxyalkylene polyamines of formulas (III) or (IV) above, preferably polyoxyalkylene diamines and polyoxyalkylene triamines, may have number average molecular weights ranging from about 200 to about 4000 and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

The amine is readily reacted with the dicarboxylic acid material, e.g. alkenyl succinic anhydride, by heating an oil solution containing 5 to 95 wt. % of dicarboxylic acid material to about 100 to 200° C., preferably 125 to 175° C., generally for 1 to 10, e.g. 2 to 6 hours until the desired amount of water is removed. The heating is preferably carried out to favor formation of imides or mixtures of imides and amides, rather than amides and salts. Reaction ratios of dicarboxylic acid material to equivalents of amine as well as the other nucleophilic reactants described herein can vary considerably, depending upon the reactants and type of bonds formed. Generally from 0.1 to 1.0, preferably about 0.2 to 0.6, e.g. 0.4 to 0.6, moles of dicarboxylic acid moiety content (e.g. grafted maleic anhydride content) is used, per equivalent of nucleophilic reactant, e.g. amine. For example, about 0.8 mole of a pentamine (having two primary amino groups and 5 equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e. preferably the pentamine is used in an amount sufficient to provide about 0.4 mole (that is $1.6/[0.8\times5]$ mole) of succinic anhydride moiety per nitrogen equivalent of the amine.

Tris(hydroxymethyl) amino methane (THAM) can be reacted with the aforesaid acid material to form amides, imides or ester type additives as taught by U.K. 984,409, or to form oxazoline compounds and borated oxazoline compounds as described, for example, in U.S. 4,102,798; 4,116,876 and 4,113,639.

The adducts may also be esters derived from the aforesaid long chain hydrocarbon substituted dicarboxylic acid material and from hydroxy compounds such as monohydric and polyhydric alcohols or aromatic compounds such as phenols and naphthols, etc. The polyhydric alcohols are the most preferred hydroxy compounds.

Suitable polyol compounds which can be used include aliphatic polyhydric alcohols containing up to about 100 carbon atoms and about 2 to about 10 hydroxyl groups. These alcohols can be quite diverse in structure and chemical composition, for example, they can be substituted or unsubstituted, hindered or unhindered, branched chain or straight chain, etc. as desired. Typical alcohols are alkylene glycols such as ethylene glycol, propylene glycol, tremethylene glycol, butylene glycol, and polyglycol such as diethylene glycol, triethylene glycol, tetraethylene glycol, dipropylene glycol, tripropylene glycol, dibutylene glycol, tributylene glycol, and other alkylene glycols and polyalkylene glycols in which the alkylene radical contains from two to about eight carbon atoms. Other useful polyhydric alcohols include glycerol , monomethyl ether of glycerol, pentaerythritol, dipentaerythritol, tripentaerythritol, 9,10-dihydroxystearic acid, the ethyl ester of 9,10-dihydroxystearic acid, 3-chloro-1, 2-propanediol, 1,2-butanediol, 1,4-butanediol, 2,3-hexanediol, pinacol, tetrahydroxy pentane, erythritol, arabitol, sorbitol, mannitol, 1,2-cyclohexanediol, 1,4-cyclohexanediol, 1,4-(2-hydroxyethyl)-cyclohexane, 1,4-dihydroxy-2-nitrobutane, 1,4-di-(2-hydroxyethyl)-benzene, and the carbohydrates such as glucose, mannose, glyceraldehyde, galactose, and the like.

Included within the group of aliphatic alcohols are those alkane polyols which contain ether groups such as polyethylene oxide repeating units, as well as those polyhydric alcohols containing at least three hydroxyl groups, at least one of which has been esterified with a mono-carboxylic acid having from eight to about 30 carbon atoms such as octanoic acid, oleic acid, stearic acid, linoleic acid, dodecanoic acid, or tall oil acid. Examples of such partially esterified polyhydric alcohols are the mono-oleate of sorbitol, the mono-oleate of glycerol, the mono-stearate of glycerol, the di-stearate of sorbitol, and the di-dodecanoate of erythritol.

A preferred class of ester containing adducts are those prepared from aliphatic alcohols containing up to 20 carbon atoms, and especially those containing three to 15 carbon atoms. This class of alcohols includes glycerol, erythritol, pentaerythritol, dipentaerythritol, tripentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis(hydroxymethyl)-cyclohexanol, 1,10-decanediol, digitalose, and the like. The esters prepared from aliphatic alcohols containing at least three hydroxyl groups and up to fifteen carbon atoms are particularly preferred.

An especially preferred class of polyhydric alcohols for preparing the ester adducts used as starting materials in the present invention are the polyhydric alkanols containing 3 to 15, especially 3 to 6 carbon atoms and having at least 3 hydroxyl groups. Such alcohols are exemplified in the above specifically identified alcohols and are represented by glycerol, etythritol, pentaerythritol, mannitol, sorbitol, 1,2,4 hexanetriol, and tetrahydroxy pentane and the like.

The ester adducts may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester adduct may be prepared by one of several known methods as illustrated for example in U.S. Pat. No. 3,381,022. The ester adduct may also be borated, similar to the nitrogen containing adduct, as described herein.

Hydroxyamines which can be reacted with the aforesaid long chain hydrocarbon substituted dicarboxylic acid material to form adducts include 2-amino-2-methyl-1propanol, p-(beta-hydroxyethyl)-aniline, 2-amino-1propanol, 3-amino-1-propanol, 2-amino-2-methyl-1,3-propane-diol, 2-amino-2-ethyl-1,3-propanediol, N-(beta-hydroxypropyl)-N'-(beta-amino-ethyl)piperazine, tris(-hydrocymethyl) amino-methane (also known as trismethylolaminomethane), 2-amino-1-butanol, ethanolamine, diethanolamine, triethanolamine, beta-(beta-hydroxyethoxy)-ethylamine and the like. Mixtures of these or similar amines can also be employed. The above description of nucleophilic reactants suitable for reaction with the hydrocarbyl substituted dicarboxylic acid or anhydride includes amines, alcohols, and compounds of mixed amine and hydroxy containing reactive functional groups, i.e. amino-alcohols.

Also useful as nitrogen containing adducts which are reacted with the polythioepoxide to form the improved dispersants of this invention are the adducts of group (ii) above wherein a nitrogen containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

Another class of nitrogen containing adducts which are reacted with the polythioepoxide to produce the dispersants of this invention are the adducts of group (iii) above which contain Mannich base or Mannich condensation products as they are known in the art. Such Mannich condensation products generally are prepared by condensing about 1 mole of a high molecular weight hydrocarbyl substituted hydroxy aromatic compound (e.g., having a number average molecular weight of 700 or greater) with about 1 to 2.5 moles of an aldehyde such as formaldehyde or paraformaldehyde and about 0.5 to 2 moles polyalkylene polyamine as disclosed, e.g., in U.S. Pat. Nos. 3,442,808; 3,649,229 and 3,798,165 (the disclosures which are hereby incorporated by reference in their entirety). Such Mannich condensation products may include a long chain, high molecular weight hydrocarbon on the phenol group or may be reacted with a compound containing such a hydrocarbon, e.g., polyalkenyl succinic anhydride as shown in said aforementioned U.S. Pat. No. 3,442,808.

The hydrocarbyl substituted hydroxy aromatic compounds used in the preparation of the Mannich base include those compounds having the formula

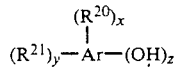

wherein Ar represents

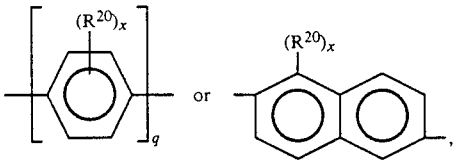

wherein q is 1 or 2, $R^{21}$ is a long chain hydrocarbon, $R^{20}$ is a hydrocarbon or substituted hydrocarbon radical having from 1 to about 3 carbon atoms or a halogen radical such as the bromide or chloride radical, y is an integer from 1 to 2, x is an integer from 0 to 2, and z is an integer from 1 to 2.

Illustrative of such Ar groups are phenylene, biphenylene, naphthylene and the like.

The preferred long chain hydrocarbon substituents represented by $R^{21}$ are olefin polymers comprising a major molar amount of $C_2$ to $C_8$, e.g. $C_2$ to $C_5$ monoolefin. Such olefins include ethylene, propylene, butylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have a number average molecular weight ($\overline{M}_n$) within the range of about 700 to about 10,000, more usually between about 700 and about 5,000. Particularly useful olefin polymers have number average molecular weight within the range of about 700 to about 3,000, and more preferably within the range of about 900 to about 2,500 with approximately one terminal double bond per polymer chain. An especially useful starting material for a highly potent dispersant additive made in accordance with this invention is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

Processes for substituting the hydroxy aromatic compounds with the olefin polymer are known in the art and may be depicted as follows:

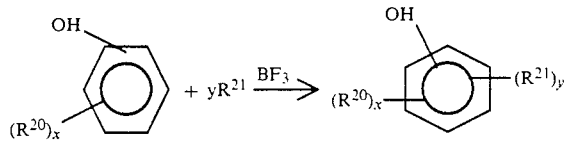

where $R^{20}$, $R^{21}$, y and x are as previously defined, and $BF_3$ is an alkylating catalyst. Processes of this type are described, for example, in U.S. Pat. Nos. 3,539,633 and 3,649,229, the disclosures of which are incorporated herein by reference.

Representative hydrocarbyl substituted hydroxy aromatic compounds contemplated for use in the present invention include, but are not limited to, 2-polypropylene phenol, 3-polypropylene phenol, 4-polypropylene phenol, 2-polybutylene phenol, 3-polyisobutylene phenol, 4-polyisobutylene phenol, 4-polyisobutylene-2-chlorophenol, 4-polyisobutylene-2-methylphenol, and the like.

Suitable hydrocarbyl-substituted polyhydroxy aromatic compounds include the polyolefin catechols, the polyolefin resorcinols, and the polyolefin hydroquinones, e.g., 4-polyisobutylene-1,2-dihydroxybenzene, 3-polypropylene-1,2-dihydroxybenzene, 5-polyisobutylene-1,3-dihydroxybenzene, 4-polyamylene-1,3-dihydroxybenzene, and the like.

Suitable hydrocarbyl-substituted naphthols include 1-polyisobutylene-5-hydroxynaphthalene, 1-polypropylene-3-hydroxynaphthalene and the like.

The preferred long chain hydrocarbyl substituted hydroxy aromatic compounds to be used in this invention can be illustrated by the formula:

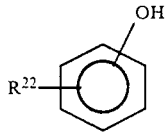

wherein $R^{22}$ is hydrocarbyl of from 50 to 300 carbon atoms, and preferably is a polyolefin derived from a $C_2$ to $C_{10}$ (e.g., $C_2$ to $C_5$) mono-alpha-olefin.

The aldehyde material which can be employed in the production of the Mannich case is represented by the formula:

$$R^{23}CHO$$

in which $R^{23}$ is a hydrogen or an aliphatic hydrocarbon radical having from 1 to 4 carbon atoms. Examples of suitable aldehydes include formaldehyde, paraformaldehyde, acetaldehyde and the like.

Yet another class of nitrogen containing adducts which are reacted with the polythioepoxide compounds to produce the dispersants of the instant invention are the adducts of group (iv) which contain Mannich base aminophenol-type condensation products as they are known in the art. Such Mannich condensation products (iv) generally are prepared by reacting about 1 mole of long chain hydrocarbon substituted mono and dicarboxylic acids or their anhydrides with about 1 mole of amine-substituted hydroxy aromatic compound (e.g., aminophenol), which aromatic compound can also be halogen- or hydrocarbyl-substituted, to form a long chain hydrocarbon substituted amine or imide-containing phenol intermediate adduct, and condensing about a molar propostion of the long chain hydrocarbon substituted amide- or imide-containing phenol intermediate adduct with about 1 to 2.5 moles of formaldehyde and about 0.5 to 2 moles of polyamine, e.g. polyakylene polyamine.

The amine substituted hydroxy aromatic compounds of this invention may be represented by the general formula:

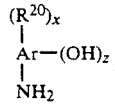

wherein $R^{20}$, x and z are as defined hereinafore. Preferred compounds are those wherein z is one.

The optionally-hydrocarbyl substituted, amine substituted hydroxy aromatic compounds used in the preparation of the Mannich base products (iv) include those compounds having the formula:

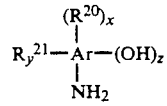

(V)

wherein Ar, $R^{21}$, $R^{20}$, x and z are as defined above. Preferred compounds are those wherein z is one.

Preferred N-(hydroxyaryl) amine reactants to be used in forming a Mannich Base product (iv) for use in this invention are amino phenols of the formula:

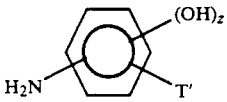

in which T' is hydrogen, an alkyl radical having from 1 to 3 carbon atoms, or a halogen radical such as the chloride or bromide radical. Preferred aminophenols are those wherein T' is hydrogen and/or z is one.

Suitable aminophenols include 2-aminophenol, 3-aminophenol, 4-aminophenol, 4-amino-3-methylphenol, 4-amino-3-chlorophenol, 4-amino-2-bromophenol and 4-amino-3-ethylphenol.

Suitable amino-substituted polyhydroxyaryls are the aminocatechols, the amino resorcinols, and the aminohydroquinones, e.g., 4-amino-1,2- dihydroxybenzene, 3-amino-1,2-dihydroxybenzene, 5-amino-1,3-dihydroxybenzene, 4-amino-1,3-dihydroxybenzene, 2-amino-1,4-dihydroxybenzene, 3-amino-1,4-dihydroxybenzene and the like.

Suitable aminonaphthols include 1-amino-5-hydroxynaphthalene, 1-amino-3-hydroxynaphthalene and the like.

The long chain hydrocarbyl substituted mono- or dicarboxylic acid or anhydride materials useful for reaction with the amine-substituted aromatic compound to prepare the amide or imide intermediates in the formation of Reactant (iv) can comprise any of those described above which are useful in preparing the reactant (i). The foregoing adducts of the long chain hydrocarbyl substituted mono- or dicarboxylic acids or their anhydrides and amine-substituted hydroxy aromatic compound can then be contacted with an aldehyde and amine for the Mannich Base reaction as described above. The aldehyde and amine can comprise any of those described above as being useful in formation of the Reactant (iii) materials.

In one preferred aspect of this invention, the dispersant adducts (iv) are prepared by reacting the olefin polymer substituted mono- or dicarboxylic acid material with the N-(hydroxyaryl) amine material to form a carbonyl-amino material containing at least one group having a carbonyl group bonded to a secondary or a tertiary nitrogen atom. In the amide form, the carbonyl-amino material contains —C(O)—NH— group, and in the imide form the carbonyl-amino material will contain —C(O)—N—C(O)— groups. The carbonyl-amino material can therefore comprise N-(hydroxyaryl) polymer-substituted dicarboxylic acid diamide, N-(hydroxyaryl) polymer-substituted dicarboxylic acid imide, N-(hydroxyaryl) polymer substituted-monocarboxylic acid monoamide, N-(hydroxyaryl) polymer-substituted dicarboxylic acid monoamide or a mixture thereof.

In general, amounts of the olefin polymer substituted mono- or dicarboxylic acid material, such as olefin polymer substituted succinic anhydride, and of the N-(hydroxyaryl) amine, such as p-aminophenol, which are effective to provide about one equivalent of dicarboxylic acid or anhydride moiety or monocarboxylic acid moiety per equivalent of amine moiety are dissolved in an inert solvent (i.e. a hydrocarbon solvent such as toluene, xylene, or isooctane) and reacted at a moderately elevated temperature up to the reflux temperature of the solvent used, for sufficient time to complete the formation of the intermediate N-(hydroxyaryl) hydrocarbyl amide or imide. When an olefin polymer substituted monocarboxylic acid material is used, the resulting intermediate which is generally formed comprises amide groups. Similarly, when an olefin polymer substituted dicarboxylic acid material is used, the resulting intermediate generally comprises imide groups, although amide groups can also be present in a portion of the carbonyl-amino material thus formed. Thereafter, the solvent is removed under vacuum at an elevated temperature, generally, at approximately 160° C. (1mm).

Alternatively, the intermediate is prepared by combining amounts of the olefin polymer substituted mono- or dicarboxylic acid material effective to provide about one equivalent of dicarboxylic acid or anhydride moiety or monocarboxylic acid moiety per equivalent of amine moiety (of the N-(hydroxyaryl) amine) and the N-(hydroxyaryl) amine, and heating the resulting mixture at elevated temperature under a nitrogen purge in the absence of solvent.

The resulting N-(hydroxyaryl) polymer substituted imides can be illustrated by the succinimides of the formula:

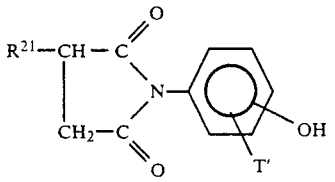

wherein T' is as defined above, and wherein $R^{21}$ is as defined above. Similarly, when the olefin polymer substituted monocarboxylic acid material is used, the resulting N-(hydroxyaryl) polymer substituted amides can be represented by the propionamides of the formula:

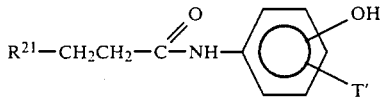

wherein T' and $R^{21}$ are as defined above.

In a second step, the carbonyl-amino intermediate is reacted with an amine compound (or mixture of amine compounds), such as a polyfunctional amine, together with an aldehyde (e.g., formaldehyde) in the Mannich base reaction. In general, the reactants are admixed and reacted at an elevated temperature until the reaction is complete. This reaction may be conducted in the presence of a solvent and in the presence of a quantity of mineral oil which is an effective solvent for the carbonyl-amino intermediate and for the finished Mannich base dispersant material. This second step can be illustrated by the Mannich base reaction between the above N-(hydroxyphenyl) polymer succinimide intermediate, paraformaldehyde and ethylene diamine in accordance with the following equation:

(Eq. A)

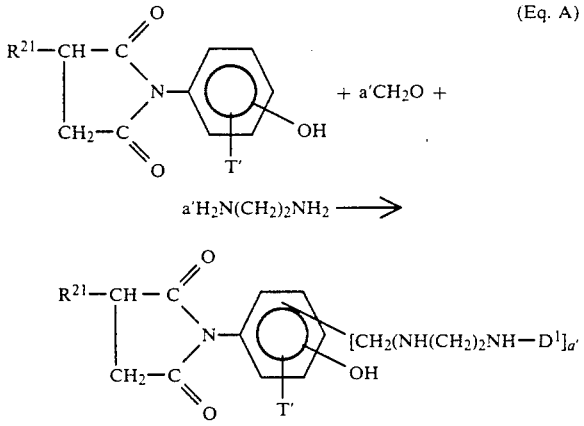

wherein a' is an integer of 1 or 2, $R^{21}$ and T' are as defined above, and $D^1$ is H or the moiety

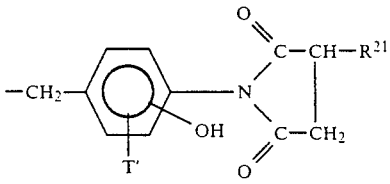

Similarly, this second step can be illustrated by the Mannich base reaction between the above N-(hydroxyphenyl) polymer acrylamide intermediate, paraformaldehyde and ethylene diamine in accordance with the following equation:

(Eq. B)

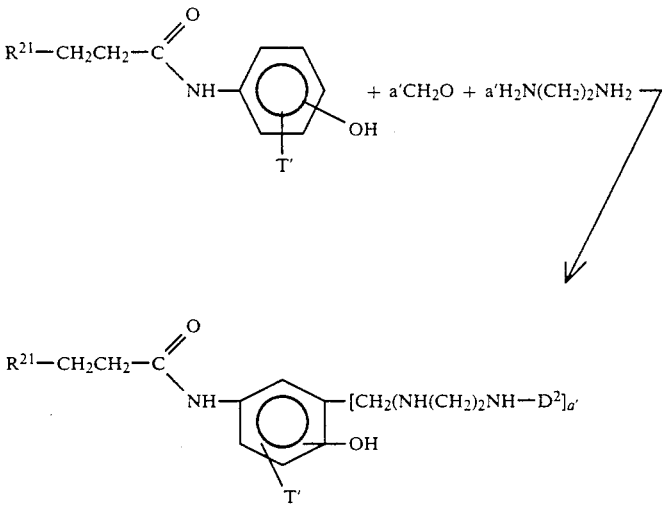

wherein a' is an integer of 1 or 2, $R^{21}$ and R' are as defined above, and $D^2$ is H or the moiety

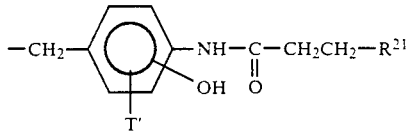

Generally, the reaction of one mole of the carbonyl-amino material, e.g. a N-(hydroxyaryl) polymer succimide or amide intermediate, with two moles of aldehyde and one mole of amine will favor formation of the products comprising two moieties of said intermediate bridged by an -alk-amine-alk- group wherein the "alk" moieties are derived from the aldehyde (e.g., $—CH_2—$ from $CH_2O$) and the "amine" moiety is a bivalent bis-N terminated amino group derived from the amine reactant (e.g., from polyalkylene polyamine). Such products are illustrated by Equations A and B above wherein "a" is one, $D^1$ is the moiety

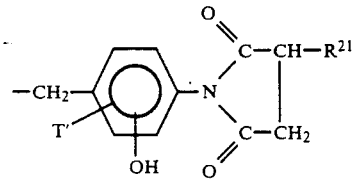

and $D^2$ is the moiety

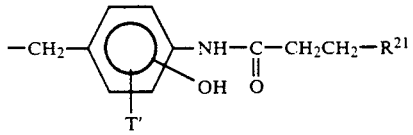

wherein T' and $R^{21}$ are as defined above.

In a similar manner, the reaction of substantially equimolar amounts of the carbonyl-amino material, aldehyde and amine reactant favors the formation of products illustrated by Equations A and B wherein "a'" is one and $D^1$ and $D^2$ are each H, and the reaction of one mole of carbonyl-amino material with two moles of aldehyde and two mole of the amine reactant permits the formation of increased amounts of the products illustrated by Equations A and B wherein "a'" is 2 and $D^1$ and $D^2$ are each H.

In preparing Reactants (iv), the order of reacting the various reactants can be modified such that, for example, the N-hydroxyaryl amine is first admixed and reacted with the amine material and aldehyde in the Mannich base reaction to form an aminomethyl hydroxyaryl amine material. Thereafter, the resulting intermediate adduct is reacted with the olefin polymer substituted mono- or dicarboxylic acid material to form the desired dispersant. The sequence of reactions performed in accordance with this aspect of the invention tends to result in the formation of various dispersant isomers because of the plurality of aromatic materials formed in the first Mannich base condensation step and the primary and secondary nitrogen atoms which are available for reaction with the carboxy moieties of the mono- or dicarboxylic acid materials.

The Mannich base intermediate adduct (iv) formed by the reaction of the N-hydroxyaryl amine with the amine reactant and formaldehyde can comprise at least one compound selected from the group consisting of:

(a) adducts of the structural formula:

$$H—(A—A')_{x1}—Ar'A'—A—(A'Ar'A'A)_{x3}—H \qquad (VI)$$

wherein $x_1$ is 0 or 1, $x_2$ is an integer of 0 to 8, $x_3$ is 0 or 1, "A" is a bivalent bis-N terminated amino group derived from the amine reactant and comprises an amine group containing from 2 to 60 (preferably from 2 to 40) carbon atoms and from 1 to 12 (preferably from 3 to 13) nitrogen atoms, and A' comprises the group —CH(T'')— wherein T'' is H or alkyl of from 1 to 9 carbon atoms and is derived from the corresponding aldehyde reactant, and Ar' comprises the moiety:

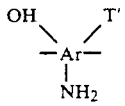

(VII)

wherein T' and Ar are as defined above for the N-hydroxyaryl amines employed in this invention; and (b) adducts of the structure:

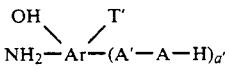

(VIII)

wherein "a'", T', A', A and Ar are as defined above. Preferred adducts of formula XXII above are those wherein $x_1$ is 0, $x_2$ is 1 to 3, and $x_3$ is 1, and most preferably wherein T' is H or alkyl of 1 to 3 carbon atoms, Ar is phenylene. Preferred adducts of this type are those wherein Ar is phenylene.

Preferably, the "A" bivalent amino group will comprise terminal —NH— groups, as exemplified by the structures of the formula:

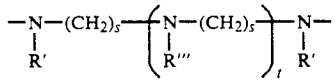

(i)

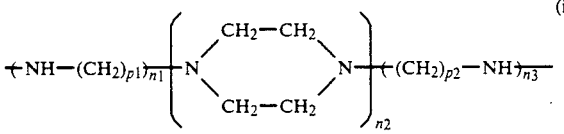

(ii)

$$—NH\text{-alkylene-}(O\text{-alkylene})_m\text{-}NH— \qquad (iii)$$

wherein R', R''' and "s" are as defined above with respect to Formula I; $p_1$, $p_2$, $n_1$, $n_2$ and $n_3$ are as defined above with respect to Formula II; "alkylene" and "m" are as defined above with respect to Formula III.

Illustrative adducts of structure (VI) are set forth in Table A below:

TABLE A

| $X_1$ | $X_2$ | $X_3$ | Ar' | A' | A |
|---|---|---|---|---|---|
| 0 | 2 | 1 | $—Ph(OH)(NH_2)—$ | $—CH_2—$ | $—NH(CH_2)_2NH(CH_2)_2NH—$ |
| 0 | 2 | 1 | " | " | $—NH(CH_2)_2(NH(CH_2))_3NH—$ |
| 0 | 1 | 0 | " | " | $—NH(CH_2)_2NH(CH_2)_2NH—$ |
| 0 | 0 | 0 | " | " | $—NH(CH_2)_2(NH(CH_2)_2)_3NH—$ |
| 0 | 1 | 1 | " | " | $—NH(CH_2)_2NH(CH_2)_2NH—$ |
| 0 | 1 | 1 | " | " | $—NH(CH_2)_2(NH(CH_2)_2)_3NH—$ |
| 1 | 2 | 0 | " | $—CH(CH_3)—$ | $—NH(CH_2)_2NH(CH_2)_2NH—$ |
| 1 | 0 | 1 | " | " | $—NH(CH_2)_2(NH(CH_2)_2)_5NH—$ |

TABLE A-continued

| $X_1$ | $X_2$ | $X_3$ | Ar' | A' | A |
|---|---|---|---|---|---|
| 1 | 3 | 0 | " | " | $-NH(CH_2)_2NH(CH_2)_5NH-$ |
| 1 | 1 | 0 | " | " | $-NH(CH_2)_2(NH(CH_2)_2)_5NH-$ |
| 1 | 1 | 1 | " | " | $-NH(CH_2)_2NH(CH_2)_5NH-$ |
| 0 | 2 | 1 | " | " | $-NH(CH_2)_2(NH(CH_2)_2)_6NH-$ |

(Ph = phenyl)

Illustrative adducts of structure (VIII) are set forth below in Table B wherein Ar is tri- or tetra-substituted phenyl:

TABLE B

| a' | T' | A' | A |
|---|---|---|---|
| 1 | H | $-CH_2-$ | $-NH(CH_2)_2NH(CH_2)_2NH-$ |
| 2 | $CH_3$ | " | $-NH(CH_2)_2(NH(CH_2)_2)_3NH-$ |
| 1 | $CH_3$ | " | $-NH(CH_2)_2NH(CH_2)_2NH-$ |
| 2 | $C_2H_5$ | " | $-NH(CH_2)_2(NH(CH_2)_2)_5NH-$ |

TABLE B-continued

| a' | T' | A' | A |
|---|---|---|---|
| 1 | $C_3H_7$ | " | $-NH(CH_2)_2NH(CH_2)_5NH-$ |
| 2 | $C_4H_9$ | " | $-NH(CH_2)_2(NH(CH_2)_3)_6NH-$ |
| 1 | H | $-CH(CH_3)-$ | $-NH(CH_2)_2NH(CH_2)_4NH-$ |
| 2 | $CH_3$ | " | $-NH(CH_2)_2(NH(CH_2)_2)_5NH-$ |

For the sake of illustration, this aspect of the invention may be represented by the following equations (wherein $R^{21}$, T' and "a'" are as defined above):

Dicarboxylic acid materials:

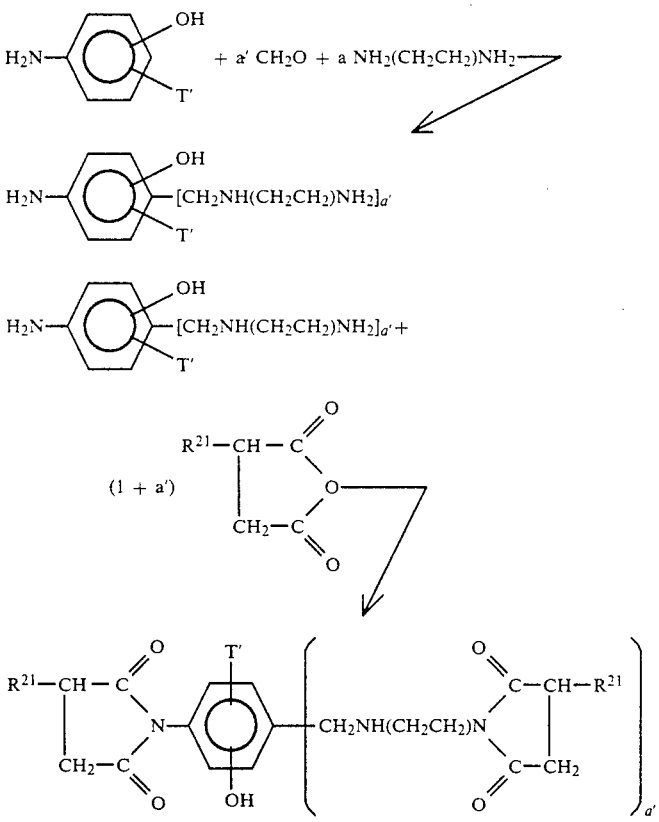

Monocarboxylic acid materials:

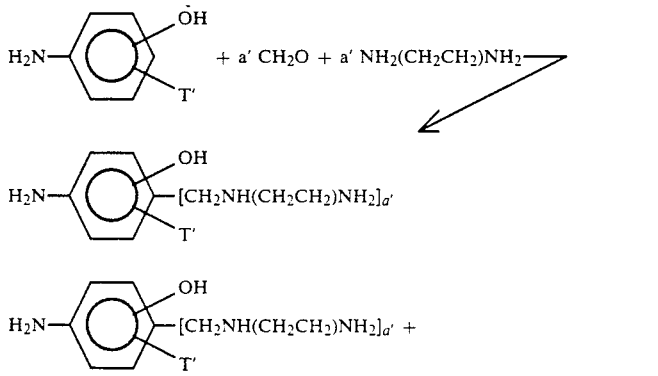

-continued

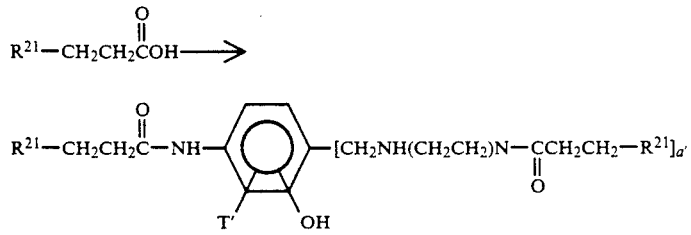

In one embodiment of the preparation of Reactants (iv), a carbonyl-amino material comprising an polyisobutylene substituted hydroxyaryl succinimide, which has been prepared by first reacting an polyisobutylene succinic anhydride with an aminophenol to form an intermediate product, is reacted with formaldehyde and a mixture of poly(ethyleneamines) in the Mannich base reaction as outlined above to form the Reactant (iv) adducts. In another embodiment, an aminophenol is first reacted with formaldehyde and a mixture of poly(ethyleneamines) in the Mannich base reaction as outlined above to form an intermediate material containing from one to three (polyamino)methyl-substituted aminohydroxy aryl groups per molecule, followed by reacting this intermediate with an polyisobutylene succinic anhydride to form the Mannich Base (iv) adducts. A preferred group of Mannich Base (iv) adducts are those formed by condensing polymer with formaldehyde and polyethylene amines, e.g., tetraethylene pentamine, pentaethylene hexamine, polyoxyethylene and polyoxypropylene amines, e.g., polyoxypropylene diamine, and combinations thereof. One particularly preferred dispersant combination involves a condensation of (a'') polymer substituted succinic anhydride or propionic acid, (b'') aminophenol, (c'') formaldehyde, and (d'') at least one of ($d''_1$) a polyoxyalkylene polyamine, e.g., polyoxypropylene diamine, and ($d''_2$) a polyalkylene polyamine, e.g. polyethylene diamine and tetraethylene pentamine, using a a'':b'':c'':d'' molar ratio of 1:1-8:1:0.1-10, and preferably 1:2-6:1:1-4, wherein the a'':($d''_1$):($d''_2$) molar ratio is 1:0-5:0-5, and preferably 1:0-4:1-4.

Most preferably, when the aldehyde comprises formaldehyde (or a material which generates formaldehyde in situ), and the amine comprises a di-primary amine (e.g., polyalkylene polyamine), the formaldehyde and diprimary amine are employed in an amount of about 2(n−1) moles of formaldehyde and about (n−1) moles of diprimary amine per "n" molar equivalents charged of the hydroxy-aryl group.

In a preferred embodiment of the instant invention the adducts which are reacted with the polythioepoxide to form the dispersants of this invention are the nitrogen containing adducts of group (i) above, i.e., those derived from a hydrocarbyl substituted dicarboxylic acid forming material (acids or anhydrides) and reacted with polyamines. These types of adducts are nomenclatured, in the specification and claims, as acylated nitrogen derivatives of hydrocarbyl substituted dicarboxylic acid materials, with the hydrocarbyl substituted dicarboxylic acid forming material being nomenclatured as an acylating agent or material. Particularly preferred adducts of this type are those derived from polyisobutylene substituted with succinic anhydride groups and reacted with polyethylene amines, e.g. tetraethylene pentamine, pentaethylene hexamine, polyoxyethylene and polyoxypropylene amines, e.g. polyoxypropylene diamine, trismethylolaminoethane and combinations thereof.

Utilizing this preferred group of nitrogen containing adducts the dispersants of the instant invention may be characterized as acylated nitrogen derivatives of hydrocarbyl substituted dicarboxylic materials comprising the reaction products of:

(A) reaction products of (1) a long chain hydrocarbyl substituted dicarboxylic acid producing material, and (2) a polyamine; subsequently reacted with (B) a polythioepoxide.

The polythioepoxides are known in the art and may be readily prepared by known methods. They are described, along with methods for their preparation, inter alia, in "Comprehensive Organic Chemistry", Vol. 3, G. C. Barrett, Sir Derek Barton and W. David Ollis, eds., Penguin Press, 1979, P. 33, (Table G), incorporated herein by reference. The polythioepoxides are compounds containing at least two thioepoxide rings, i.e.,

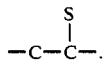

These thioepoxide rings are connected or joined by hydrocarbon moieties or hydrocarbon moieties containing at least one hetero atom or group. The hydrocarbon moieties generally contain from 1 to about 100 carbon atoms. They include the alkylene, cycloalkylene, alkenylene, arylene, aralkenylene and alkarylene radicals. Typical alkylene radicals are those containing from 1 to about 100 carbon atoms, more typically from 1 to about 50 carbon atoms. The alkylene radicals may be straight chain or branched and may contain from 1 to about 100 carbon atoms, preferably from 1 to about 50 carbon atoms. Typical cycloalkylene radicals are those containing from 4 to about 16 ring carbon atoms. The cycloalkylene radicals may contain alkyl substituents, e.g., $C_1$–$C_8$ alkyl, on one or more ring carbon atoms. Typical arylene radicals are those containing from 6 to 12 ring carbons, e.g., phenylene, naphthylene and biphenylene. Typical alkarylene and aralkylene radicals are these containing from 7 to about 100 carbon atoms, preferably from 7 to about 50 carbon atoms. The hydrocarbon moieties joining the thioepoxide rings may contain substituent groups thereon. The substituent groups are those which are substantially inert or unreactive at ambient conditions with the thioepoxide ring. As used in the specification and appended claims the term "substantially inert and unreactive at ambient conditions" is intended to mean that the atom or group is substantially inert to chemical reactions at ambient temperatures and pressure with the thioepoxide ring so as not to materially interfere in an adverse manner with the preparation and/or functioning of the compositions, additives, compounds, etc. of this invention in the context of its intended use. For example, small amounts of these atoms or groups can undergo minimal reaction with the thioepoxide ring without preventing the making and using of the invention as described herein. In other words, such reaction, while technically discernable, would not be sufficient to deter the practical worker of ordinary skill in the art from making and using the invention for its intended purposes. Suitable substituent groups include, but are not limited to, alkyl groups, hydroxyl groups, tertiary amino groups, halogens, and the like. When more than one substituent is present they may be the same or different.

It is to be understood that while many substituent groups are substantially inert or unreactive at ambient conditions with the thioepoxide ring, they will react with the thioepoxide ring under conditions effective to allow reaction of the thioepoxide ring with the reactive amino groups of the acylated nitrogen derivatives of hydrocarbyl substituted dicarboxylic materials. Whether these groups are suitable substituent groups which can be present on the polythioepoxide depends, in part, upon their reactivity with the thioepoxide ring. Generally, if they are substantially more reactive with the thioepoxide ring than the thioepoxide ring is with the reactive amino group, particularly the secondary amino group, they will tend to materially interfere in an adverse manner with the preparation of the improved dispersants of this invention and are, therefore, unsuitable. If, however, their reactivity with the thioepoxide ring is less than or generally similar to the reactivity of the thioepoxide ring with the reactive amino groups, particularly a secondary amino group, they will not materially interfere in an adverse manner with the preparation of the dispersants of the present invention and may be present on the polythioepoxide, particularly if the thioepoxide groups are present in excess relative to the substituent groups. An example of such a reactive but suitable group is the hydroxyl group. An example of an unsuitable substituent group is a primary amino group.

The hydrocarbon moieties containing at least one hetero atom or group are the hydrocarbon moieties described above which contain at least one hetero atom or group in the chain. The hetero atoms or groups are those that are substantially unreactive at ambient conditions with the thioepoxide rings. When more then one hetero atom or group is present they may be the same or different. The hetero atoms or groups are separated from the carbon atom of the thioepoxide ring by at least one intervening carbon atom. These hetero atom or group containing hydrocarbon moieties may contain at least one substituent group on at least one carbon atom. These substituent groups are the same as those described above as being suitable for the hydrocarbon moieties.

Some illustrative non-limiting examples of suitable hetero atoms or groups include:

oxygen atoms (i.e., —O— or ether linkages in the carbon chain);

sulfur atoms (i.e. —S— or thioether linkages in the carbon chain);

carboxy groups

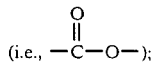

sulfonyl group

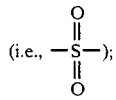

ketone group

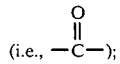

sulfinyl group

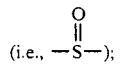

a thioepoxide ring

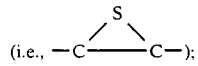

and nitro group.

As mentioned hereinafore the polythioepoxides of the present invention contain at least two thioepoxide rings. It is critical that the polythioepoxide contain at least two thioepoxide rings in the same molecule. Preferably, these polythioepoxides contain no more than about 10 thioepoxide rings, preferably no more than about 5 thioepoxide rings. Preferred polythioepoxides are the dithioepoxides, i.e., those containing two thioepoxide rings.

The polythioepoxides useful in the instant invention are well known in the art and are generally commercially available or may readily be prepared by conventional and well known methods.

The polythioepoxides include those represented by the general formula

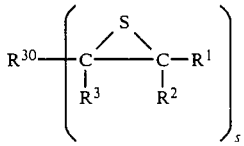

wherein:

$R^{30}$ is a s valent hydrocarbon radical, a substituted s valent hydrocarbon radical, a s valent hydrocarbon radical containing at least one hetero atom or group, and a substituted s valent hydrocarbon radical containing at least one hetero atom or group; $R^1$–$R^3$ are as described herein below; and s is an integer having a value of at least 2, preferably from 2 to about 10, more preferablly from 2 to about 5. In this generic formula $R^{30}$ has the same meaning as R in Formula V below except that it is s valent rather than divalent.

Among the polythioepoxides described hereinafore are those represented by the general formula.

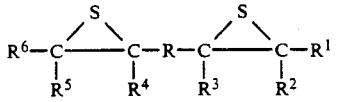

IX.

wherein:

R is a divalent hydrocarbon radical, a substituted divalent hydrocarbon radical, a divalent hydrocarbon radical containing at least one hetero atom or group, and a substituted divalent hydrocarbon radical containing at least one hetero atom or group.;

$R^1$ and $R^6$ are independently selected from hydrogen, monovalent hydrocarbon radicals, substituted monovalent hydrocarbon radicals, monovalent hydrocarbon radicals containing at least one hetero atom or group, substituted monovalent hydrocarbon radicals containing at least one hetero atom or group, and thioepoxide containing radicals;

$R^2$ and $R^3$ are independently selected from hydrogen, monovalent hydrocarbon radicals, substituted monovalent hydrocarbon radicals, monovalent hydrocarbon radicals containing at least one hetero atom or group, substituted monovalent hydrocarbon radicals containing at least one hetero atom or group, monovalent thioepoxide containing radicals, divalent hydrocarbon radicals, and substituted divalent hydrocarbon radicals, with the proviso that if $R^2$ or $R^3$ is a divalent hydrocarbon radical or substituted divalent hydrocarbon radical then both $R^2$ and $R^3$ must be divalent hydrocarbon radicals or substituted divalent hydrocarbon radicals that together with the two carbon atoms of the thioepoxide ring form a cyclic structure; and $R^4$ and $R^5$ are independently selected from hydrogen, monovalent hydrocarbon radicals, substituted monovalent hydrocarbon radicals, monovalent hydrocarbon radicals containing at least one hetero atom or group, substituted monovalent hydrocarbon radicals containing at least one hetero atom or group, monovalent thioepoxide containing radicals, divalent hydrocarbon radicals, and substituted divalent hydrocarbon radicals, with the proviso that if $R^4$ or $R^5$ is a divalent hydrocarbon radical or substituted divalent hydrocarbon radical then both $R^4$ and $R^5$ must be divalent hydrocarbon radicals or substituted divalent hydrocarbon radicals that together with the two carbon atoms of the thioepoxide ring form a cyclic structure.

The monovalent hydrocarbon radicals represented by $R^1$–$R^6$ generally contain from 1 to about 100 carbon atoms. These hydrocarbon radicals include alkyl, alkenyl, cycloalkyl, aryl, aralkyl, and alkaryl radicals. The alkyl radicals may contain from 1 to about 100, preferably from 1 to about 50, carbon atoms and may be straight chain or branched. The alkenyl radicals may contain from 2 to about 100 carbons, preferably from 2 to about 50 carbon atoms, and may be straight chain or branched. Preferred cycloalkyl radicals are those containing from about 4 to about 12 ring carbon atoms, e.g., cyclobutyl, cyclopentyl, cyclohexyl, cycloheptyl, etc. These cycloalkyl radicals may contain substituent groups, preferably alkyl groups, on the ring carbon atoms, e.g., methylcyclohexyl, 1,3-dimethylcyclopentyl, etc. The preferred alkenyl radicals are those containing from 2 to about 30 carbon atoms, e.g., ethenyl, 1-propenyl, 2-propenyl, etc. The preferred aryl radicals are those containing from 6 to about 12 ring carbon atoms, i.e., phenyl, naphthyl, and biphenyl. The preferred aralkyl and alkaryl radicals are those containing from 7 to about 30 carbon atoms, e.g., p-tolyl, 2,6-xylyl, 2,4,6-trimethylphenyl, 2-isopropylphenyl, benzyl, 2-phenylethyl, 4-phenylbutyl, etc.

The substituted monovalent hydrocarbon radicals represented by $R^1$–$R^6$ are the monovalent hydrocarbon radicals described hereinafore which contain at least one substituent group thereon. The substituent groups are such that they are substantially unreactive under ambient conditions with the thioepoxide moieties. When more than one substituent group is present they may be the same or different.

The monovalent hydrocarbon radicals containing at least one hetero atom or group are the monovalent hydrocarbon radicals described hereinafore which contain at least one hetero atom or group in the carbon chain. The hetero atom or group is separated from the carbon of the thioepoxide ring by at least one intervening carbon atom. When more than one hetero atom or group is present they may be the same or different. The hetero atoms or groups are those that are substantially unreactive under ambient conditions with the thioepoxide ring. These hetero atoms or groups are those described hereinafore.

The substituted monovalent hydrocarbon radicals containing at least one hetero atom or group are the substituted monovalent hydrocarbon radicals containing at least one hetero atom or group described above which contain at least one substituent group on at least one carbon atom. The substituent groups are those described hereinafore.

The thioepoxide radicals represented by $R^1$–$R^6$ may be represented by the formula

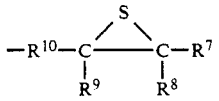

X.

wherein:

$R^7$ has the same meaning as $R^1$, $R^8$–$R^9$ have the same meaning as $R^2$–$R^3$, and $R^{10}$ has the same meaning as R in Formula IX.

The divalent hydrocarbon radicals represented by $R^2$–$R^5$ and $R^8$–$R^9$ generally are aliphatic acyclic radicals and contain from 1 to about 5 carbon atoms. Preferred divalent hydrocarbon radicals are the alkylene radicals. Preferred alkylene radicals are those that, together with the two carbon atoms of the thioepoxide ring, form a cyclic structure containing from 4 to about 8 ring carbon atoms. Thus, for example, if $R^3$ and $R^4$ are both ethylene radicals the resultant cyclic structure formed with the two carbon atoms of the thioepoxide ring is a cyclohexylene sulfide i.e.,

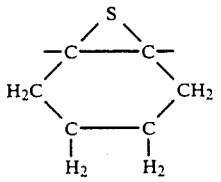

The divalent substituted hydrocarbon radicals represented by $R^2$–$R^5$ and $R^8$–$R^9$ are the divalent hydrocarbon radicals described above which contain at least one substituent group on at least one carbon atom. Thus, for example, if $R^3$ and $R^4$ are both hydroxy substituted ethylene radicals, the resultant cyclic structure formed with the two carbon atoms of the thioepoxide ring may be represented by the formula.

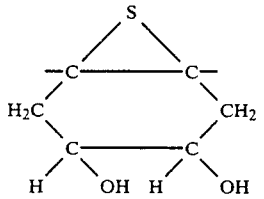

The divalent hydrocarbon radicals represented by R and $R^{10}$ generally contain from 1 to about 100 carbon atoms, preferably from 1 to about 50 carbon atoms. They may be aliphatic, aromatic or aliphatic-aromatic. If they are aliphatic they may be saturated or unsaturated, acyclic or alicyclic. They include alkylene, cycloalkylene, alkenylene, arylene, aralkylene, and alkarylene radicals. The alkylene radicals may be straight chain or branched. Preferred alkylene radicals are those containing from 1 to about 50 carbon atoms. Preferred alkenylene radicals are those containing from 2 to about 50 carbon atoms. Preferred cycloalkylene radicals are those containing from 4 to about 12 ring carbon atoms. The cycloalkylene radicals may contain substituents, preferably alkyls, on the ring carbon atoms.

It is to be understood that the term "arylene" as used in the specification and the appended claims is not intended to limit the divalent aromatic moiety represented by R and $R^{10}$ to benzene. Accordingly, it is to be understood that the divalent aromatic moiety can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least one aromatic nucleus is fused at two points to another nucleus such as found in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, methylene linkages, alkylene linkages, di-(lower alkyl)-methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages.

When the divalent aromatic moiety, Ar, is a linked polynuclear aromatic moiety it can be represented by the general formula $$-Ar(Lng-Ar-_2$$

wherein w is an integer of 1 to about 10, preferably 1 to about 8, more preferably 1, 2 or 3; Ar is a divalent aromatic moiety as described above, and each Lng is a bridging linkage individually chosen from the group consisting of carbon-to-carbon single bonds, ether linkages (e.g. —O—), keto linkages $$\text{(e.g., } -\overset{\overset{\displaystyle O}{\|}}{C}-\text{),}$$

sulfide linkages (e.g., —S—), polysulfide linkages of 2 to 6 sulfur atoms (e.g., $-S_2-$), sulfinyl linkages (e.g., —S(O)—), sulfonyl linkages (e.g., $-S(O)_2-$), lower alkylene linkages $$-CH_2-,\ -CH_2-CH_2-,\ -CH_2-\underset{\underset{\displaystyle R^*}{|}}{CH}-,\ \text{etc.),}$$

di (lower alkyl) -methylene linkages (e.g., $-CR^*2-$), lower alkylene ether linkages (e.g., $$-CH_2-O-,\ -CH_2-O-CH_2-CH_2-CH_2-O-,$$

$$-CH_2CH_2OCH_2CH_2-CH_2\underset{\underset{\displaystyle R^*}{|}}{C}HOCH_2\underset{\underset{\displaystyle R^*}{|}}{C}H-$$

$$-CH_2\underset{\underset{\displaystyle R^*}{|}}{C}HO\underset{\underset{\displaystyle R^*}{|}}{C}HCH_2-\quad \text{etc.)}$$

lower alkylene sulfide linkages (e.g., wherein one or more —O—,s in the lower alkylene ether linkages is replaced with an —S— atom), lower alkylene polysulfide linkages (e.g., wherein one or more —O—'s is replaced with a —S2 to —S6— group), with R* being a lower alkyl group.

Illustrative of such linked polynuclear aromatic moieties are those represented by the formula

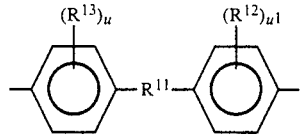

wherein $R^{12}$ and $R^{13}$ are independently selected from hydrogen and alkyl radicals, preferably alkyl radicals containing from 1 to about 2 0 carbon atoms; R11 is selected from alkylene, alkylidene, cycloalkylene, and cycloalkylidene radicals; and u and ul are independently selected from integers having a value of from 1 to 4.

The divalent substituted hydrocarbon radicals represented by R and $R_{10}$ are those divalent hydrocarbon radicals described above which contain at least one substituent group of the type described hereinafore. Thus, for example, if the divalent hydrocarbon radical is a $C_5$ alkylene, the corresponding divalent substitute hydrocarbon radical, e.g., hydroxyl substituted radical, may be $$-CH_2-\underset{\underset{\displaystyle OH}{|}}{CH_2}-CH-CH_2-CH_2-$$

more than one substituent group is present they may be the same or different.

The divalent hydrocarbon radicals containing at least one hetero atom or group are those divalent hydrocarbon radicals described hereinafore which contain at least one hetero atom or group. These hetero atoms or groups are those described hereinafore. Some illustrative non-limiting examples of divalent hydrocarbon radicals containing at least one hetero atom or group include:

$-CH_2-O-CH_2-$;

$-CH_2-O-CH_2-CH_2-O-CH_2-$;

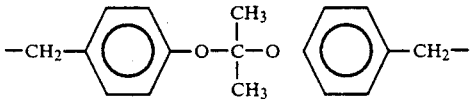

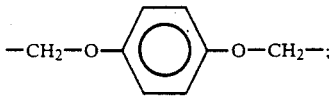

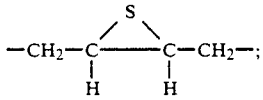

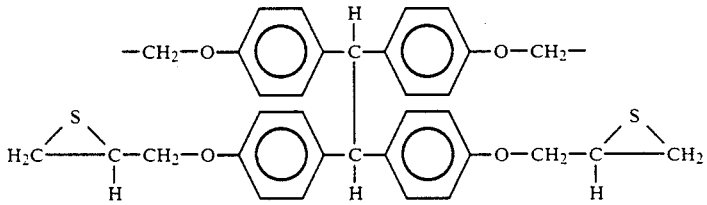

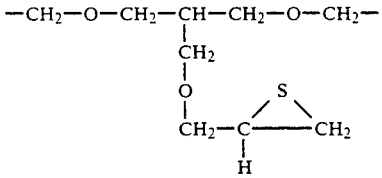

The divalent substituted hydrocarbon radicals containing at least one hetero atom or group are those divalent hydrocarbon radicals containing at least one hetero atom or group described above which contain at least one substituent group of the type described hereinafore. Some illustrative non-limiting examples of divalent substituted hydrocarbon radicals containing at least one hetero atom or group include:

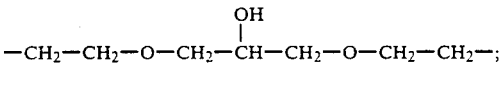

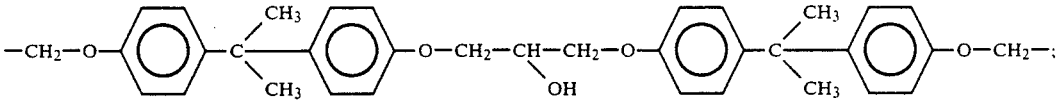

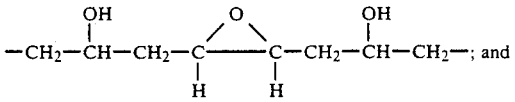

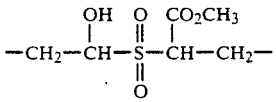

Also included within the scope of the polythioepoxides of the instant invention are these represented by the formula

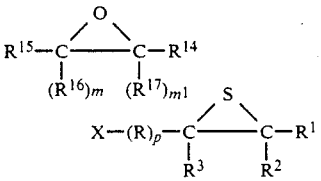

XI.

wherein:

R and $R^1$–$R^3$ are as defined hereinafore; $R^{14}$ and $R^{15}$ independently have the same meaning as $R^1$; X is an aromatic moiety; $R^{16}$ and $R^{17}$ are independently selected from divalent aliphatic acyclic hydrocarbon radicals and divalent substituted aliphatic acyclic hydrocarbon radicals which together with the two carbon atoms of the thioepoxide ring and the two adjacent ring carbon atoms of the aromatic moiety X form a cyclic structure;

m and $m^1$ are independently zero or one with the proviso that the sum of m plus $m^1$ is at least one; and p is zero or one.

The aromatic moieties represented by X are preferably those containing from 6 to 12 ring carbon atoms, e.g., benzene, napthalene, and biphenyl. The aromatic moieties may contain one or more substituents on one or more ring carbon atoms. These substituents are those which are substantially unreactive at ambient conditions, e.g., temperature and pressure, with the thioepoxide ring. They include, for example, alkyl, hydroxyl, nitro, and the like.

Also falling within the scope of the polythioepoxides of the instant invention are those represented by the formula:

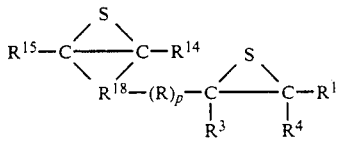

XII.

wherein:

R, $R^1$–$R^3$, $R^{14}$–$R^{15}$ and p are as defined hereinafore; and $R^{18}$ is independently selected from divalent hydrocarbon radicals or a substituted divalent hydrocarbon radicals which together with the two carbon atoms of the thioepoxide ring forms a cyclic preferably cycloaliphatic, structure.

The divalent hydrocarbon or substituted divalent hydrocarbon radicals represented by $R^{18}$ preferably contain from 2 to about 14 carbon atoms so as to form, together with the two carbon atoms of the thioepoxide ring, a 4 to about 16 membered ring structure, preferably a cycloaliphatic ring. The preferred divalent hydrocarbon radicals are the divalent aliphatic hydrocarbon radicals, preferably the alkylene radicals.

The divalent aliphatic hydrocarbon radicals represented by $R^{18}$ may contain one or more substituent groups on one or more ring carbon atoms. The substituents are selected from those that are substantially unreactive under ambient conditions with the thioepoxide ring, e.g., alkyl, hydroxyl, and the like.

Preferred polythioepoxides of the instant invention are those wherein at least two of the thioepoxide rings, preferably the two terminal or end thioepoxide rings, are unhindered. By unhindered is meant that the thioepoxide ring contains one secondary carbon atom, i.e., having two hydrogens bonded thereto, and preferably contains one secondary carbon atom and one tertiary carbon atom, i.e., having one hydrogen bonded thereto. Thus, for example, an unhindered polythioepoxide of Formula IX is one wherein $R^1$, $R^2$, $R^5$, and $R^6$ are hydrogen, preferably one wherein $R^1$–$R^3$ and $R^4$–$R^6$ are all hydrogen.

Some illustrative non-limiting Examples of the polythioepoxides of the instant invention include:

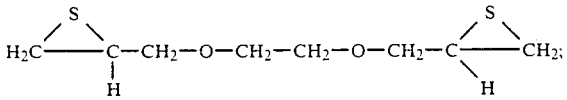

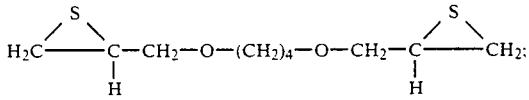

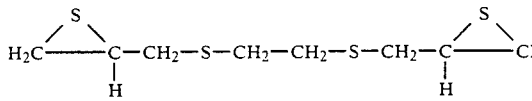

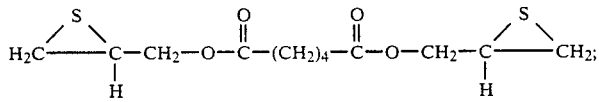

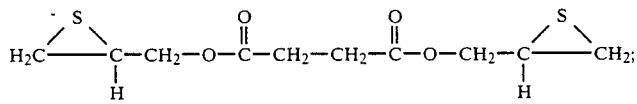

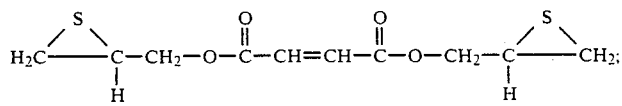

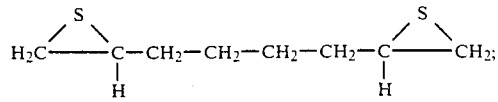

-continued

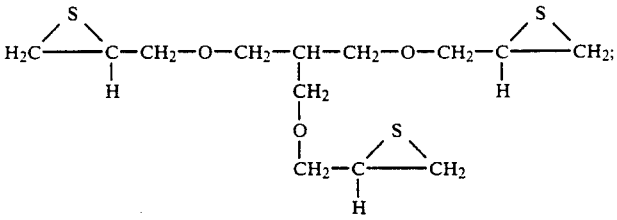

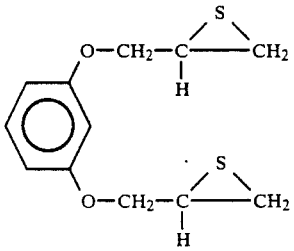

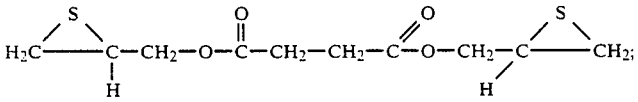

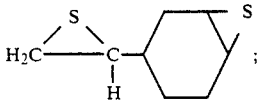

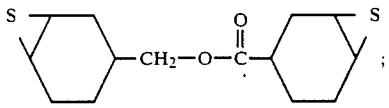

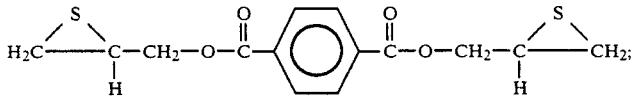

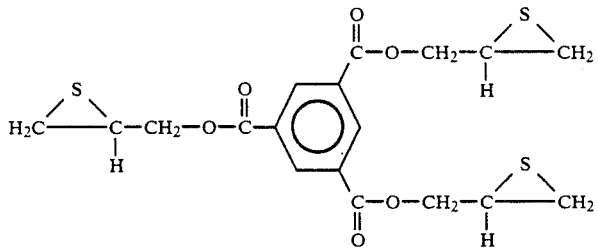

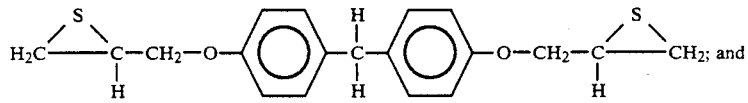

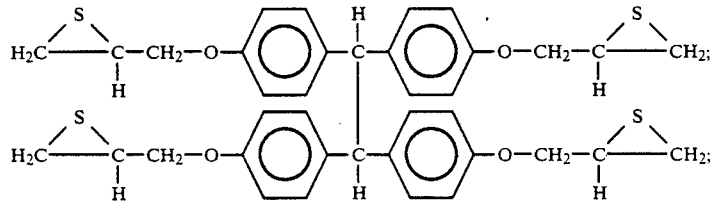

As mentioned hereinafore those polyethiopoxides wherein the two carbon atoms of the thioepoxide ring are bonded to three hydrogen atoms, e.g., wherein $R^1$–$R^6$ in Formula IX are all hydrogen, are preferred. Preferred polythioepoxides of this type are those wherein the hydrocarbon moieties bridging the thioepoxide moieties, e.g., R in Formula IX, contain polar groups or atoms. These polar groups or atoms include, but are not limited to, the polar hetero atoms or groups described hereinafore.

These polythioepoxides are reacted with the nitrogen or ester containing adducts selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; (iii) Mannich condensation products formed by condensing a long chain hydrocarbon substituted phenol with an aldehyde and polyamine, or (iv) Mannich condensation product formed by reacting long chain hydrocarbyl substituted mono- or dicarboxylic acid or its anhydride with an amino containing hydroxy aromatic compound to form a long chain hydrocarbyl substituted amide or imide-containing hydroxy aromatic compound intermediate adduct, and condensing this intermediate adduct aldehyde and polyamine to form the improved dispersants of the present invention. In the case of nitrogen containing adducts these adducts that are further reacted with the polythioepoxides in accordance with the present invention contain sufficient unreacted residual reactive amino groups, i.e., primary and/or secondary amino groups, to enable the desired reaction with the polythioepoxides to take place. This reaction involves a ring opening of the thioepoxide ring whereby different molecules of the adduct are joined or coupled by the ring opened thioepoxide moieties on the same polythioepoxide molecule.

In one embodiment the nitrogen containing adduct is of group (i). Such an adduct, as discussed hereinafore, may be characterized as an acylated nitrogen derivative of hydrocarbyl substituted dicarboxylic acid producing materials. While the following discussion is directed to this embodiment, it is to be understood that, with minor modifications, it is equally applicable to the other adducts of groups (i)-(iv) which may be used in the instant invention.

The polythioepoxides of the present invention are reacted with the acylated nitrogen derivatives of hydrocarbyl substituted dicarboxylic acid materials. The acylated nitrogen derivatives that are further reacted with the polythioepoxides in accordance with the present invention contain sufficient unreacted residual reactive amino nitrogens, e.g., secondary amino nitrogens, to enable the desired reaction with the polythioepoxides to take place. This reaction is between the remaining reactive nitrogens of the acylated nitrogen derivatives and the thioepoxide rings of the polythioepoxide, and involves ring opening of the thioepoxide rings whereby different molecules of the acylated nitrogen derivatives are joined or coupled by the ring opened thioepoxide moieties on the same polyethiopoxide molecule. That is to say different thioepoxide rings on the same polythioepoxide molecule react with amino groups on different molecules of the acylated nitrogen derivatives, thereby coupling or linking these different acylated nitrogen derivative molecules.

Reaction may be carried out by adding an amount of polythioepoxide to the acylated nitrogen derivative which is effective to link or chain extend at least some of the molecules of the acylated nitrogen derivative, i.e., chain extending effective amount. It will be apparent to those skilled in the art that the amount of polythioepoxide utilized will depend upon (i) the number of reactive nitrogen atoms present in the acylated nitrogen derivative, (ii) the number of thioepoxide rings present in the polythioepoxide, (iii) any participation from other functional groups present on the polythioepoxide in the reaction and, (iv) the number of such groups which it is desired to react, i.e., the degree of coupling or cross-linking it is desired to obtain.

Generally, however, it is preferred to utilize an amount of polythioepoxide such that there are present from about 0.01 to about 5, preferably from about 0.05 to about 2, and more preferably from about 0.1 to about 1 equivalent of thioepoxide per equivalent of reactive residual amino group in the acylated nitrogen derivative.

The temperature at which the reaction is carried out generally ranges from about 50° C. to the decomposition temperature of the mixture, preferably from about 50° C. to about 250° C., and more preferably from about 100° C., to about 200° C. While superatmospheric pressures are not excluded, the reaction generally proceeds at atmospheric pressure. The reaction may be conducted using a mineral oil, e.g., 100 neutral oil as a solvent. An inert organic co-solvent, e.g., xylene or toluene, may also be used. The reaction time generally ranges from about 0.5-24 hours.

The products of this embodiment are formed as a result of bonding i.e. formation of a carbon to nitrogen bond, of different thioepoxide moieties on the same polythioepoxide molecule with a reactive amino group, preferably a secondary amino group, on different molecules of the acylated nitrogen derivative. The product may, for purposes of illustration and examplification only, be represented by the following formula and reaction scheme:

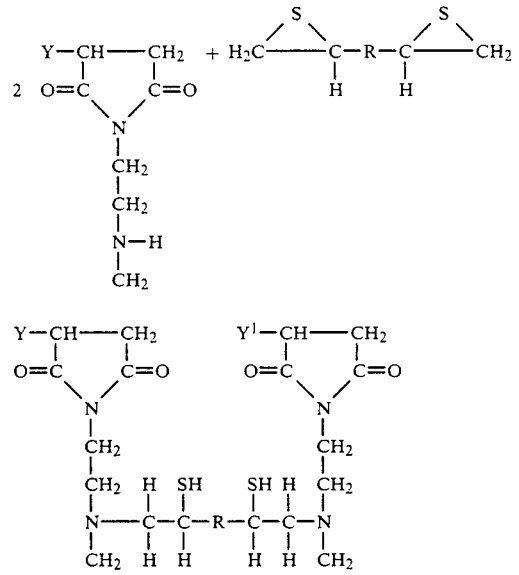

wherein Y is independently selected from olefin polymers containing at least 30 carbon atoms. .This type of product is obtained from the reaction of an acylated nitrogen derivative containing only one residual reactive amino group per molecule, e.g., secondary amino group, and a polythioepoxide containing only two thioepoxide rings per molecule. If the acylated nitrogen derivative contains more than one residual reactive amino group per molecule and/or the polythioepoxide contains more than two thioepoxide rings per molecule then the products will be more complex, e.g., a polythioepoxide containing three thioepoxide rings per molecule may join or couple three different acylated nitrogen derivative molecules containing one residual reactive amino group per molecule.

If the acylated nitrogen derivative contains more than one residual reactive amino group per molecule, e.g., two secondary amino groups, and the polythioepoxide contains two thioepoxide rings, then one acylated nitrogen derivative molecule could, depending on the stoichiometry of the reaction, be be joined to two other acylated nitrogen derivative molecules by two polythioepoxide molecules. This may be illustrated by the following structures:

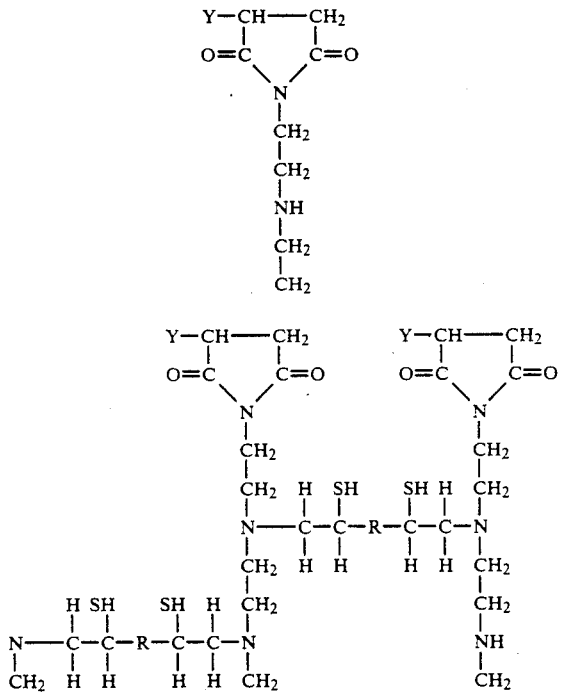

The polythioepoxide is, in effect, a chain extender or cross-linking agent serving to join together two or more molecules of acylated nitrogen derivative. The product, since it contains two or more acylated nitrogen derivative molecules bonded together, has a higher molecular weight and may be characterized as an oligomer or even a polymer. The molecular weight of the product will depend, inter alia, upon the number of reactive amino groups per molecule of acylated nitrogen derivative, the number of thioepoxide rings per molecule of polythioepoxide, and the amount of polythioepoxide present in the reaction mixture of polythioepoxide and acylated nitrogen derivative. For example, if an acylated nitrogen derivative containing only one residual reactive amino group, preferably a secondary amino group, per molecule is reacted with a dithioepoxide the product will be a dimer of the acylated nitrogen derivative. In such a situation increasing the amount of the dithioepoxide will generally not result in an increase in the molecular weight of the resultant dimer molecule but will yield more dimer molecules. On the other hand, if an acylated nitrogen derivative containing more than one residual reactive amino group per molecule is reacted with a dithioepoxide, the molecular weight of the product molecule may be increased in addition to the production of more cross-linked molecules.

Further aspects of the present invention reside in the formation of metal complexes and other post-treatment derivatives, e.g., borated derivatives, of the novel additives prepared in accordance with this invention. Suitable metal complexes may be formed in accordance with known techniques of employing a reactive metal ion species during or after the formation of the present dispersant materials. Complex-forming metal reactants include the nitrates, thiocyanates, halides, carboxylates, phosphates, thio-phosphates, sulfates, and borates of transition metals such as iron, cobalt, nickel, copper, chromium, manganese, molybdenum, tungsten, ruthenium, palladium, platinum, cadmium, lead, silver, mercury, antimony and the like. Prior art disclosures of these complexing reactions may be found in U.S. Pat. Nos. 3,306,908 and Re. 26,443.

Post-treatment compositions include those formed by reacting the novel additives of the present invention with one or more post-treating reagents, usually selected from the group consisting of boron oxide, boron oxide hydrate, boron halides, boron acids, sulfur, sulfur chlorides, phosphorous sulfides and oxides, carboxylic acid or anhydride acylating agents, epoxides and episulfides and acrylonitriles. The reaction of such post-treating agents with the novel additives of this invention is carried out using procedures known in the art. For example, boration may be accomplished in accordance with the teachings of U.S. Pat. No. 3,254,025 by treating the additive compound of the present invention with a boron oxide, halide, ester or acid. Treatment may be carried out by adding about 1-3 wt. % of the boron compound, preferably boric acid, and heating and stirring the reaction mixture at about 135° C. to 165° C. for 1 to 5 hours followed by nitrogen stripping and filtration, if desired. Mineral oil or inert organic solvents facilitate the process.

The compositions produced in accordance with the present invention have been found to be particularly useful as fuel and lubricating oil additives.

When the compositions of this invention are used in normally liquid petroleum fuels, such as middle distillates boiling from about 150° to 800° F. including kerosene, diesel fuels, home heating fuel oil, jet fuels, etc., a concentration of the additive in the fuel in the range of typically from 0.001 wt. % to 0.5 wt. %, preferably 0.005 wt. % to 0.2 wt. %, based on the total weight of the composition, will usually be employed. These additives can contribute fuel stability as well as dispersant activity and/or varnish control behavior to the fuel.

The compounds of this invention find their primary utility, however, in lubricating oil compositions, which employ a base oil in which the additives are dissolved or dispersed. Such base oils may be natural or synthetic.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalpha-olefins, polybutenes, alkyl benzenes, organic esters of phosphoric acids, polysilicone oils, etc. selected type of lubricating oil composition can be included as desired.

The additives of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil employ a base oil in which the additives are dissolved or dispersed. Such base oils may be natural or synthetic.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalpha-olefins, polybutenes, alkyl benzenes, organic esters of phosphoric acids, polysilicone oils, etc. selected type of lubricating oil composition can be included as desired.

The additives of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed. Moreover, the additional incorporation of other additives may also permit incorporation of higher levels of a particular polymer adduct hereof, if desired.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalpha-olefins, polybutenes, alkyl benzenes, organic esters of phosphoric acids, polysilicone oils, etc. selected type of lubricating oil composition can be included as desired.

The additives of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed. Moreover, the additional incorporation of other additives may also permit incorporation of higher levels of a particular polymer adduct hereof, if desired.

Accordingly, while any dispersant effective amount of these additives can be incorporated into the fully formulated lubricating oil composition, it is contemplated that such effective amount be sufficient to provide said lube oil composition with an amount of the additive of typically from 0.01 to about 10, e.g., 0.1 to 6.0, and preferably from 0.25 to 3.0 wt. %, based on the weight of said composition.

The additives of the present invention can be incorporated into the lubricating oil in any convenient way. Thus, they can be added directly to the oil by dispersing, or dissolving the same in the oil at the desired level of concentration, typically with the aid of a suitable solvent such as toluene, cyclohexane, or tetrahydrofuran. Such blending can occur at room temperature or elevated.

Natural base oils include mineral lubricating oils which may vary widely as to their crude source, e.g., whether paraffinic, naphthenic, mixed, paraffinicnaphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 2.5 to about 9 cSt. at 100° C.

Thus, the additives of the present invention can be employed in a lubricating oil composition which comprises lubricating oil, typically in a major amount, and the additive, typically in a minor amount, which is effective to impart enhanced dispersancy relative to the absence of the additive. Additional conventional additives selected to meet the particular requirements of a temperatures. In this form the additive per se is thus being utilized as a 100% active ingredient form which can be added to the oil or fuel formulation by the purchaser. Alternatively, these additives may be blended with suitable oil-soluble solvent and base oil to form concentrate, which may then be blended with a lubricating oil base stock to obtain the final formulation. Concentrates will typically contain from about 2 to 80 wt. %, by weight of the additive, and preferably from about 5 to 40% by weight of the additive.

The lubricating oil base stock for the additive of the present invention typically is adapted to perform selected function by the incorporation of additives therein to form lubricating oil compositions (i.e., formulations).

Representative additives typically present in such formulations include viscosity modifiers, corrosion inhibitors, oxidation inhibitors, friction modifiers, other dispersants, anti-foaming agents, anti-wear agents, pour point depressants, detergents, rust inhibitors and the like.

Viscosity modifiers impart high and low temperature operability to the lubricating oil and permit it to remain shear stable at elevated temperatures and also exhibit acceptable viscosity or fluidity at low temperatures. These viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have weight average molecular weights of from about 10,000 to 1,000,000, preferably 20,000 to 500,000, as determined by gel permeation chromatography or light scattering methods.

Representative examples of suitable viscosity modifiers are any of the types known to the art including polyisobutylene, copolymers of ethylene and propylene, polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at temperature in the range of about 66 to about 316° C. Neutralization of the phosphosulfurized hydrocarbon may be effected in the manner taught in U.S. Pat. No. 1,969,324.

Oxidation inhibitors, or antioxidants, reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably C5 to C12 alkyl side chains, e.g., calcium nonylphenol sulfide, barium toctylphenyl sulfide, dioctylphenylamine, phenylalphanaphthylamine, phospho-sulfurized or sulfurized hydrocarbons, etc.

Other oxidation inhibitors or antioxidants useful in this invention comprise oil-soluble copper compounds. The copper may be blended into the oil as any suitable oil soluble copper compound. By oil soluble it is meant that the compound is oil soluble under normal blending conditions in the oil or additive package. The copper compound may be in the cuprous or cupric form. The copper may be in the form of the copper dihydrocarbyl thio- or dithio-phosphates. Alternatively, the copper may be added as the copper salt of a synthetic or natural carboxylic acid. Examples of same thus include $C_{10}$ to $C_{18}$ fatty acids, such as stearic or palmitic acid, but unsaturated acids such as oleic or branched carboxylic acids such as napthenic acids of molecular weights of from about 200 to 500, or synthetic carboxylic acids, are preferred, because of the improved handling and solubility properties of the resulting copper carboxylates. Also useful are oil-soluble copper dithiocarbamates of the general formula $(R^{30}R^{31},NCSS)zCu$ (where z is 1 or 2, and $R^{30}$ and $R^{31}$, are the same or different hydrocarbyl radicals containing from 1 to 18, and preferably 2 to 12, carbon atoms, and including radicals such as alkyl, alkenyl, aryl, aralkyl, alkaryl and cycloaliphatic radicals. Particularly preferred as $R^{30}$ and $R^{31}$, groups are alkyl groups of from 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., $R^{30}$ and $R^{31}$,) will generally be about 5 or greater. Copper sulphonates, phenates, and acetylacetonates may also be used.

Exemplary of useful copper compounds are copper $Cu^{I}$ and/or $Cu^{II}$ salts of alkenyl succinic acids or anhydrides. The salts themselves may be basic, neutral or acidic. They may be formed by reacting (a) polyalkylene succinimides (having polymer groups of $\overline{M}_n$ of 700 to 5,000) derived from polyalkylene-polyamines, which have at least one free carboxylic acid group, with (b) a reactive metal compound. Suitable reactive metal compounds include those such as cupric or cuprous hydroxides, oxides, acetates, borates, and carbonates or basic copper carbonate.

Examples of these metal salts are Cu salts of polyisobutenyl succinic anhydride, and Cu salts of polyisobutenyl succinic acid. Preferably, the selected metal employed is its divalent form, e.g., Cu+2. The preferred substrates are polyalkenyl succinic acids in which the alkenyl group has a molecular weight greater than about 700. The alkenyl group desirably has a $\overline{M}_n$ from about 900 to 1,400, and up to 2,500, with a $\overline{M}_n$ of about 950 being most preferred. Especially preferred is polyisobutylene succinic anhydride or acid. These materials may desirably be dissolved in a solvent, such as a mineral oil, and heated in the presence of a water solution (or slurry) of the metal bearing material. Heating may take place between 70° C. and about 200° C. Temperatures of 100° C. to 140° C. are entirely adequate. It may be necessary, depending upon the salt produced, not to allow the reaction to remain at a temperature above about 140° C. for an extended period of time, e.g., longer than 5 hours, or decomposition of the salt may occur.

The copper antioxidants (e.g., Cu-polyisobutenyl succinic anhydride, Cu-oleate, or mixtures thereof) will be generally employed in an amount of from about 50 to 500 ppm by weight of the metal, in the final lubricating or fuel composition.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinamic acid and mixtures thereof; U.S. Pat. No. 3,879,306 which discloses N(hydroxyalkyl) alkenyl succinimic acids or succinimides: U.S. Pat. No. 3,932,290 which discloses reaction products of di- (lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobisalkanols such as described in U.S. Pat. No. 4,344,853.

Dispersants maintain oil insolubles, resulting from oxidation during use, in suspension in the fluid thus preventing sludge flocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

Pour point depressants, otherwise known as lube oil flow improvers, lower the temperature at which the fluid will flow or can be poured. Such additives are well known. Typically of those additives which usefully optimize the low temperature fluidity of the fluid are C8–C18 dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and di-carboxylic acids. Highly basic (viz. overbased) metal sales, such as highly basic alkaline earth metal sulfonates (especially Ca and Mg salts) are frequently used as detergents. Representative examples of such materials, and their methods of preparation, are found in co-pending Ser. No. 32,066, filed Mar. 27, 1987, the disclosure of which is hereby incorporated by reference.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | Wt. % a.i. (Broad) | Wt. % a.i. (Preferred) |
|---|---|---|
| Viscosity Modifier | 0.01-12 | 0.01-4 |
| Corrosion Inhibitor | 0.01-5 | 0.01-1.5 |
| Oxidation Inhibitor | 0.01-5 | 0.01-1.5 |
| Dispersant | 0.1-20 | 0.1-8 |
| Pour Point Depressant | 0.01-5 | 0.01-1.5 |
| Anti-Foaming Agents | 0.001-3 | 0.001-0.15 |
| Anti-Wear Agents | 0.001-5 | 0.001-1.5 |
| Friction Modifiers | 0.01-5 | 0.01-1.5 |
| Detergents/Rust Inhibitors | 0.01-10 | 0.01-3 |
| Mineral Oil Base | Balance | Balance |

When other additives are employed it may be desirable, although not necessary, to prepare additive concentrates comprising concentrated solutions or dispersions of the dispersant (in concentrate amounts hereinabove described), together with one or more of said other additives (said concentrate when constituting an additive mixture being referred to herein as an additive package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the dispersant additive and optional additional additives in proper amounts to provide the desired concentration in the final formulation when the additive-package is combined with a predetermined amount of base lubricant. Thus, the products of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

All of said weight percents expressed herein are based on active ingredient (a.i.) content of the additive, and/or upon the total weight of any additive-package, or formulation which will be the sum of the a.i. weight of each additive plus the weight of total oil or diluent.

What is claimed is:

1. An oil soluble composition dispersant useful as a dispersant additive for lubricating composition comprising the reaction products of:

(1) at least one nitrogen containing adduct selected from the group consisting of (i) Mannich condensation product formed by condensing a long chain hydrocarbyl substituted hydroxy aromatic compound with aldehyde and polyamine: and (ii) Mannich condensation product formed by reacting long chain hydrocarbyl substituted mono or dicarboxylic acid or anhydride thereof with amine containing hydroxy aromatic compound, which may be optionally hydrocarbyl substituted, to form long chain hydrocarbyl substituted amide or imide-containing hydroxy aromatic compound intermediate adduct, and condensing said long chain hydrocarbyl substituted amide or imide-containing hydroxy aromatic compound adduct with aldehyde and polyamine; said adduct containing at least one reactive group selected from reactive amino groups and reactive hydroxyl groups; and (2) at least one polythioepoxide.

2. The composition according to claim 1 wherein said long chain hydrocarbyl in (1) (i) and (1) (ii) is a polymer of at least one $C_2$ to $C_{18}$ monoolefin, said polymer having a number average molecular weight of from about 500 to about 6,000.

3. The composition according to claim 1 wherein said polythioepoxide contains at least two thioepoxide rings joined by hydrocarbon moieties, substituted hydrocarbon moieties, hydrocarbon moieties containing at least one hetero atom or groups, or substituted hydrocarbon moieties containing at least one hetero atom or group.

4. The composition according to claim 3 wherein said hydrocarbon moieties are selected from alkylene, cycloalkylene, alkenylene, arylene, alkarylene, and alkarylene radicals.

5. The composition according to claim 3 wherein the substituent groups present on the hydrocarbon moieties and the hetero atoms or groups present in the hydrocarbon chain are substantially inert or unreactive at ambient conditions with the thioepoxide rings of the polythioepoxide.

6. The composition according to claim 3 wherein said polythioepoxide contains at least two thioepoxide rings wherein one thioepoxide ring carbon atom is bonded to two hydrogen atoms.

7. The composition according to claim 6 wherein the second thioepoxide ring carbon atoms is bonded to a hydrogen atom.

8. The composition according to claim 1 wherein (1) is a nitrogen containing adduct of group (i).

9. The composition according to claim 8 wherein (i) is Mannich condensation product formed by condensing about a molar proportion of long chain hydrocarbyl substituted phenol with about 1 to 2.5 moles of formaldehyde and about 0.5 to 2 moles of polyamine.

10. The composition according to claim 1 wherein (1) is a nitrogen containing adduct of group (ii).

11. The composition according to claim 10 wherein (ii) is Mannich condensation product formed by reacting long chain hydrocarbyl substituted mono or dicarboxylic acid or anhydride thereof with aminophenol, which may be optionally hydrocarbyl substituted, to form long chain hydrocarbyl substituted amide or imide-containing phenol intermediate adduct, and condensing said long chain hydrocarbyl substituted amide or imide-containing intermediate adduct with aldehyde and polyamine.

12. The composition according to claim 11 wherein said long chain hydrocarbyl is a polymer of at least one $C_2$ to $C_{18}$ alpha-olefin, said polymer having a number average molecular weight of from about 500 to about 6,000.

13. A lubricating composition comprising:

(A) major amount of a lubricating oil; and (B) a minor amount of an oil soluble dispersant which is effective to impart enhanced dispersancy comprising the reaction product of (1) at least one nitrogen containing adduct selected from the group consisting of (i) Mannich condensation product formed by condensing long chain hydrocarbyl substituted hydroxy aromatic compound with an aldehyde and polyamine; and (ii) Mannich condensation product formed by reacting long chain hydrocarbyl substituted mono or dicarboxylic acid or anhydride thereof with amine containing hydroxy aromatic compound, which may be optionally hydrocarbyl substituted, to form long chain hydrocarbyl substituted amide or imide-containing hydroxy aromatic compound intermediate adduct, and condensing said long chain hydrocarbyl substituted amide or imide-containing hydroxy aromatic compound adduct with aldehyde and polyamine; said adduct containing at least one reactive group selected from reactive amino groups and reactive hydroxyl groups, and (2) at least one polythioepoxide.

14. The composition according to claim 13 wherein said long chain hydrocarbyl in (B) (1) (i) and (B) (1) (ii) is a polymer of at least one $C_2$ to $C_{18}$ monoolefin, said polymer having a number average molecular weight of about 500 to about 6,000.

15. The composition according to claim 13 wherein said polythioepoxide contains at least two thioepoxide rings joined by hydrocarbon moieties, substituted hydrocarbon moieties, hydrocarbon moieties containing at least one hetero atom or group, or substituted hydrocarbon moieties containing at least one hetero atom or group.

16. The composition according to claim 15 wherein said hydrocarbon moieties are selected from alkylene, alkenylene, cycloalkylene, arylene, aralkylene and alkarylene moieties.

17. The composition according to claim 15 wherein said polythioepoxide contains at least two thioepoxide rings wherein one thioepoxide ring carbon atom is bonded to two hydrogens.

18. The composition according to claim 17 wherein the second thioepoxide ring carbon atoms is bonded to a hydrogen atom.

19. The composition according to claim 13 which is an additive concentrate comprising about 5 to 70 wt.% of lubricating oil (A) and 20 to 95 wt.% of (B).

20. The composition according to claim 13 wherein (B) (1) is a nitrogen containing adduct of group (i).

21. The composition according to claim 20 wherein (B) (1) (i) is Mannich condensation product formed by condensing about a molar proportion of long chain hydrocarbyl substituted phenol with about 1 to 2.5 moles of formaldehyde and about 0.5 to 2 moles of polyamine.

22. The composition according to claim 13 wherein (B) (1) is a nitrogen containing adduct of group (ii).

23. The composition according to claim 22 wherein (B) (1) (ii) is Mannich condensation product formed by reacting long chain hydrocarbyl substituted mono or dicarboxylic acid or anhydride thereof with aminophenol, which may be optionally hydrocarbyl substituted, to form long chain hydrocarbyl substituted amide or imide-containing phenol intermediate adduct, and condensing said long chain hydrocarbyl substituted amide or imide-containing intermediate adduct with aldehyde and polyamine.

24. The composition according to claim 23 wherein said long chain hydrocarbyl is a polymer of at least one $C_2$ to $C_{18}$ alpha-olefin, said polymer having a number average molecular weight of from about 500 to about 6,000.

* * * * *